US012263996B2

(12) United States Patent
van den Hoonaard et al.

(10) Patent No.: US 12,263,996 B2
(45) Date of Patent: Apr. 1, 2025

(54) TAMPER-EVIDENT CAP

(71) Applicant: Cheer Pack North America LLC, West Bridgewater, MA (US)

(72) Inventors: Paul van den Hoonaard, West Bridgewater, MA (US); Stephen Gosling, West Bridgewater, MA (US); Peter J. Walters, Barrington, IL (US); David Williamson, West Bridgewater, MA (US)

(73) Assignee: Cheer Pack North America LLC, West Bridgewater, MA (US)

( * ) Notice: Subject to any disclaimer, the term of this patent is extended or adjusted under 35 U.S.C. 154(b) by 297 days.

(21) Appl. No.: 17/881,177

(22) Filed: Aug. 4, 2022

(65) Prior Publication Data

US 2023/0089722 A1 Mar. 23, 2023

Related U.S. Application Data

(63) Continuation-in-part of application No. 17/477,776, filed on Sep. 17, 2021, now Pat. No. 11,702,252.

(51) Int. Cl.
*B65D 47/10* (2006.01)
*B65D 47/12* (2006.01)
(Continued)

(52) U.S. Cl.
CPC ..... *B65D 47/10* (2013.01); *B65D 47/122* (2013.01); *B65D 51/24* (2013.01); *B65D 75/5883* (2013.01)

(58) Field of Classification Search
CPC ..... B65D 41/3409; B65D 41/3428; B65D 41/3404; B65D 41/34; B65D 41/62;
(Continued)

(56) References Cited

U.S. PATENT DOCUMENTS 4,457,437 A * 7/1984 Heath, Jr. ..... B65D 41/3409 215/206
5,512,228 A 4/1996 Adams et al.
(Continued)

FOREIGN PATENT DOCUMENTS

EP 2870076 B1 5/2016
FR 2251193 A 6/1975
(Continued)

OTHER PUBLICATIONS

International Search Report and Written Opinion for International Application No. PCT/US2022/039426, mailed Nov. 10, 2022, 12 pages.
(Continued)

*Primary Examiner* — Robert J Hicks
(74) *Attorney, Agent, or Firm* — Nutter McClennen & Fish LLP

(57) ABSTRACT

A tamper-evident closure for a container includes a straw having an outer edge with an outwardly extending projection. The closure includes a cap with a rib. A tamper-evident tab extends from the rib. The tab has an inwardly extending lug configured to engage with the outwardly extending projection of the straw as the cap rotates relative to the straw. The tab has a hinge coupled with the rib. The hinge is configured to rotate the tab outwardly relative to the rib. The tab also has a foldable portion configured to fold to provide a visual indication when the cap is an unsealed configuration.

20 Claims, 27 Drawing Sheets

(51) Int. Cl.
*B65D 51/24* (2006.01)
*B65D 75/58* (2006.01)

(58) Field of Classification Search
CPC ..... B65D 47/32; B65D 75/5883; B65D 75/5872; B65D 75/5866; B65D 75/5861; B65D 2213/00; B65D 47/10; B65D 47/122; B65D 51/24; A47G 19/2266
USPC ..... 215/252, 251, 250, 229, 228; 220/266, 220/265, 709, 705, 212
See application file for complete search history.

(56) References Cited

U.S. PATENT DOCUMENTS

| | | | |
|---|---|---|---|
| D467,501 | S | 12/2002 | Tacchella |
| D547,657 | S | 7/2007 | Tacchella |
| D552,483 | S | 10/2007 | Rigardo |
| D679,597 | S | 4/2013 | Tamarindo |
| D684,058 | S | 6/2013 | Kwon |
| 8,528,757 | B2 | 9/2013 | Bisio |
| D717,650 | S | 11/2014 | Tamarindo |
| 8,950,939 | B2 | 2/2015 | Last et al. |
| 9,016,473 | B2 | 4/2015 | Tamarindo |
| D735,038 | S | 7/2015 | Tamarindo |
| 9,187,217 | B2 | 11/2015 | Bisio |
| 9,290,306 | B2 | 3/2016 | Totten |
| 9,446,158 | B2 | 9/2016 | Laguzzi |
| D775,532 | S | 1/2017 | Basson |
| 9,708,095 | B2 | 7/2017 | Rosselli |
| D799,322 | S | 10/2017 | Tamarindo |
| 9,782,502 | B2 | 10/2017 | Laguzzi |
| 10,202,225 | B2 | 2/2019 | Tamarindo |
| D842,699 | S | 3/2019 | Tamarindo |
| 10,232,985 | B2 | 3/2019 | Bisio |
| 10,245,336 | B2 | 4/2019 | Tamarindo |
| 10,472,133 | B2 | 11/2019 | Tamarindo |
| 10,588,990 | B2 | 3/2020 | Tamarindo |
| D885,893 | S | 6/2020 | Tamarindo |
| 10,710,753 | B2 | 7/2020 | Tamarindo |
| D905,072 | S | 12/2020 | Buzzi |
| 10,934,038 | B2 | 3/2021 | Last |
| 2012/0211460 | A1 | 8/2012 | Tamarindo |
| 2014/0010481 | A1 | 1/2014 | Last et al. |
| 2015/0129533 | A1 | 5/2015 | Taber et al. |
| 2015/0232237 | A1 | 8/2015 | Berge et al. |
| 2018/0170626 | A1 | 6/2018 | Kwon |
| 2019/0106233 | A1 | 4/2019 | Tamarindo |
| 2019/0168924 | A1 | 6/2019 | Tamarindo |
| 2019/0202605 | A1 | 7/2019 | Bisio |
| 2020/0262635 | A1 | 8/2020 | Buzzi et al. |
| 2021/0293599 | A1* | 9/2021 | Paterson ..... G01F 11/263 |
| 2022/0135286 | A1* | 5/2022 | Gosling ..... B65D 75/5883 220/288 |

FOREIGN PATENT DOCUMENTS

| | | | |
|---|---|---|---|
| GB | 849578 | A | 9/1960 |
| WO | 2007117897 | A2 | 10/2007 |
| WO | 2012/028980 | A1 | 3/2012 |
| WO | 2019/229561 | A1 | 12/2019 |

OTHER PUBLICATIONS

Hoffer Plastics, "Trust-T-Lok Family of Tamper Evident Closures," retrieved from the Internet at https://hofferplastics.com/products/trust-t-lok/, on Aug. 1, 2022 (8 pages).
Menshen, "Weldspouts Comprehensive Standard Program and Powerful Partner for Customter Specific Developments," retrieved from the internet at https://www.menshen.com/portfolio/weldspouts/, on Aug. 1, 2022 (7 pages).
Scholle Ipn, "ArrowCap CS85 + CC85AR," retrieved from the internet at https://www.scholleipn.com/products/arrowcap-cs85-rl-cc85ar/, on Aug. 2, 2022 (9 pages).

* cited by examiner

TAMPER-EVIDENT CAP

PRIORITY

This patent application is a continuation-in-part application of U.S. patent application Ser. No. 17/477,776, filed Sep. 17, 2021, entitled "TAMPER-EVIDENT CLOSURE FOR CONTAINER," and naming Steve Gosling, Peter J. Walters, and David Williamson as inventors, the disclosure of which is incorporated herein, in its entirety, by reference.

FIELD OF THE INVENTION

The present disclosure generally relates to tamper-evident closures for containers and related methods. For example, closures of the present disclosure can be used in conjunction with pouches or other containers that hold perishable food.

BACKGROUND OF THE INVENTION

Various closures have been used to seal flexible pouches containing liquids, pastes, gels and similar products. Some closures are designed for single use, meaning that once the closure is opened or removed, the contents are to be fully consumed and the closure is not designed to be placed back on the opening or spout. However, some closures are designed to re-seal the opening and to preserve the contents remaining the pouch. For resealable closures, there is often no visual indication that the cap was partially or completely removed and then placed back onto the spout. This presents a safety hazard as customers would like to know if the contents are fresh, have been exposed to the atmosphere, or if they have been tampered with.

Among other things, the flexible pouches may be part of a fruit juice containers normally used by children. Different countries have varying child safety regulations intended to prevent choking by children. These regulations tend to provide restrictions on the dimensions of the cap so as to prevent the possibility that the caps are swallowed by the children.

SUMMARY OF VARIOUS EMBODIMENTS

In accordance with one embodiment of the invention, a tamper-evident closure for a container includes a straw having an outer edge with an outwardly extending projection. The closure includes a cap with a rib. A tamper-evident tab extends from the rib. The tab has an inwardly extending lug configured to engage with the outwardly extending projection of the straw as the cap rotates relative to the straw when the cap and the straw are secured together. The tab has a has a foldable portion configured to fold the lug inwardly to provide a visual indication when the cap is an unsealed configuration.

In various embodiments, the cap has a plurality of ribs. In some embodiments, the tab may extend circumferentially from a first rib to a second rib. For example, a hinge of the tab may be coupled with the first rib and a break segment of the tab make be coupled with the second rib. In some other embodiments, the tab may extend circumferentially across the rib. For example, a break segment of a first tab may be coupled with a second tab.

In accordance with another embodiment, a tamper-evident closure for a container includes a straw having an outer edge with an outwardly extending projection. The closure includes a cap with a rib. A tamper-evident tab extends from the rib. The tab has an inwardly extending lug configured to engage with the outwardly extending projection of the straw as the cap rotates relative to the straw. The tab has a hinge coupled with the rib. The hinge is configured to rotate the tab outwardly relative to the rib. The tab also has a foldable portion configured to fold to provide a visual indication when the cap is an unsealed configuration.

Among other things, the tab may include a break segment that is configured to break when a threshold force is applied to transition the closure from a sealed configuration to an unsealed configuration. The cap may include a plurality of ribs. The hinge of the tab may be coupled with a first rib and the break segment may be coupled with a second rib. The hinge may include a recessed portion of the tab.

In some embodiments, the cap includes an outer shell having gripping features. The cap may also include an inner cap body. The plurality of ribs may extend from the inner cap body to the outer shell. The inner cap body may have internal threads configured to engage with external threads on the straw. A ratio of a maximum height of the outer shell to a height of one of the plurality of tabs is less than or equal 6:1.

In accordance with another embodiment, a method visually indicating that a container has been tampered with. The method provides a container in a sealed configuration. The container has a straw with an outer edge having an outwardly extending projection. The container may also include a cap sealed to the straw. The cap has a rib with a tab extending from the rib. The tab has an inwardly extending lug configured to engage with the outwardly extending projection of the straw as the cap is rotated relative to the straw. The tab also has a hinge coupled with the rib. The hinge is configured to swing the tab outwardly relative to the rib. The tab also has a foldable portion configured to fold. The cap is rotated relative to the straw to overcome a threshold force. The tab swings outwardly at the hinge. The tab also folds at the foldable portion.

In various embodiments the tab includes a break segment configured to break when the threshold force is applied. The method may also break the break segment. In various embodiments, rotating the cap relative to the straw causes the lug of the cap to engage with the projection of the straw.

The cap may include a plurality of ribs. In some embodiments, the hinge is coupled with a first rib and the break segment is coupled with a second rib. The cap may also include an outer shell having gripping features, and an inner cap body. The inner cap body includes threads configured to engage with threads on the straw. The plurality of ribs may extend from the inner cap body to the outer shell.

In accordance with another embodiment, a tamper-evident system includes a container configured to house a fluid, a straw, and a cap. The straw is partially sealed within the container. The straw has an exposed portion and an unexposed portion. Specifically, the straw has an exposed outer edge with an outwardly extending projection. The system also includes one or more tabs configured to rotate outwardly, the tab further having a foldable portion configured to fold.

In various embodiments, the one or more tabs are coupled to the ribs. The tab may also have an inwardly extending lug configured to engage with the outwardly extending projection of the straw as the cap is coupled with and rotated relative to the straw. In various embodiments, the lug has a slideable surface configured to slide along the projection after the closure is in the unsealed configuration. Various embodiments may rotate the cap relative to the straw in the unsealed configuration so that the slideable surface slides on the projection. Advantageously, the slideable surface provides reduced or no ratcheting noise.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a tamper evident container has a cap with tabs that swing outwardly to provide a visual indication that the container has been unsealed/tampered with. The tabs may also fold to further project outwardly and provide an enhanced visual indication. Details of illustrative embodiments are discussed below.

Figure 1:
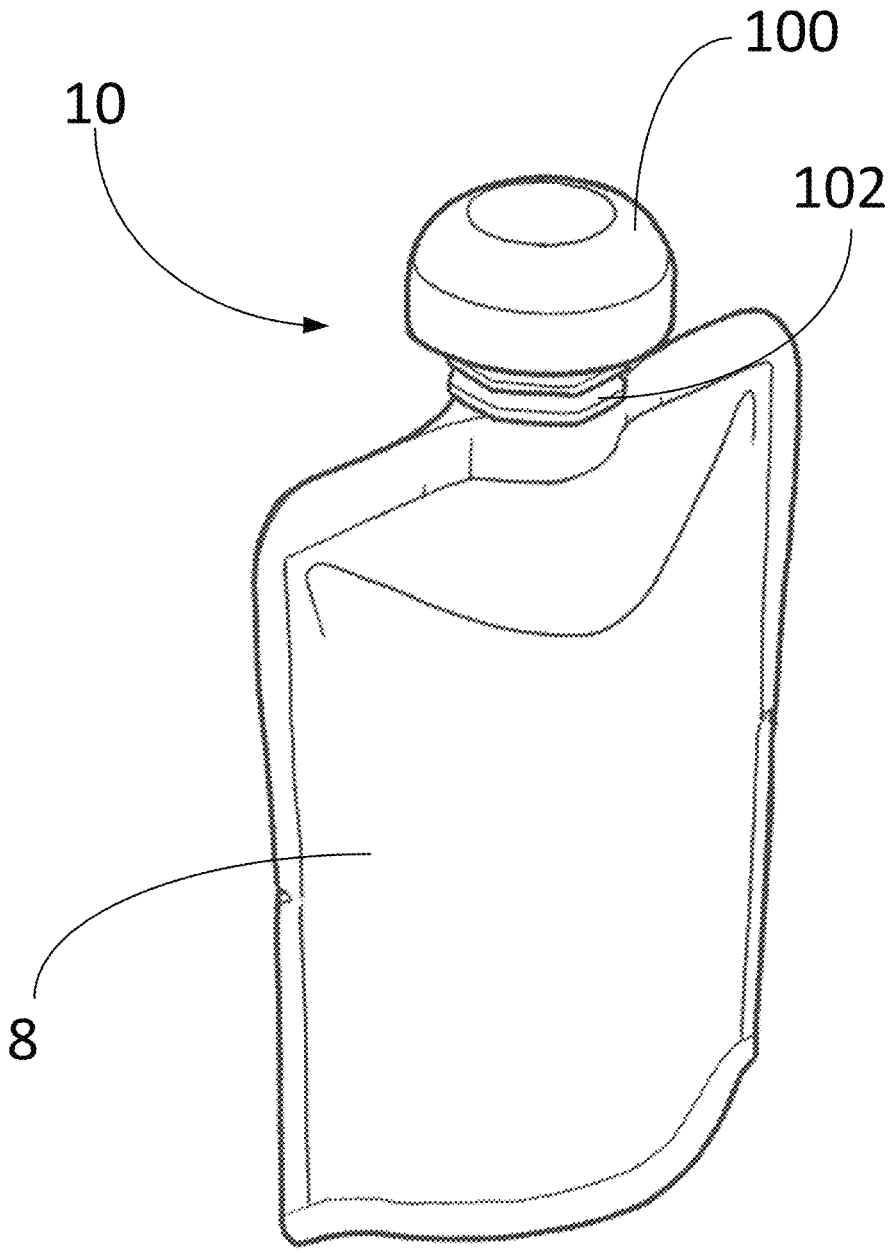
FIG. 1 schematically shows a container in accordance with illustrative embodiments of the invention.

FIG. 1 schematically shows a container 8, such as a flexible pouch. The container 8 may contain perishable food or drink. To access the contents of the container 8, the container 8 includes a straw 102 (also referred to as a spout 102) with a cap 100 (the straw 102 and the cap 100 are collectively referred to as a device 10). The container 8 or portions thereof may be sealed (e.g., hermetically) around the device 10. The user may access the contents, for example, by drinking through the straw 102.

To ensure the quality of the contents within the container 8, it is desirable to provide a tamper evident seal that visually indicates when a seal between the cap 100 and the straw 102 is broken. This is desirable, for example, because the hermetic seal of the container 8 may be broken when the cap 100 is opened, thereby allowing oxygen into the container 8 and possibly accelerating spoilage of the contents within the container 8. As another example, it is desirable for a user to know if a third party has opened and possibly tampered with, contaminated, or altered the contents within the container 8. To that end, illustrative embodiments provide a tamper evident device 10.

Figure 2A:
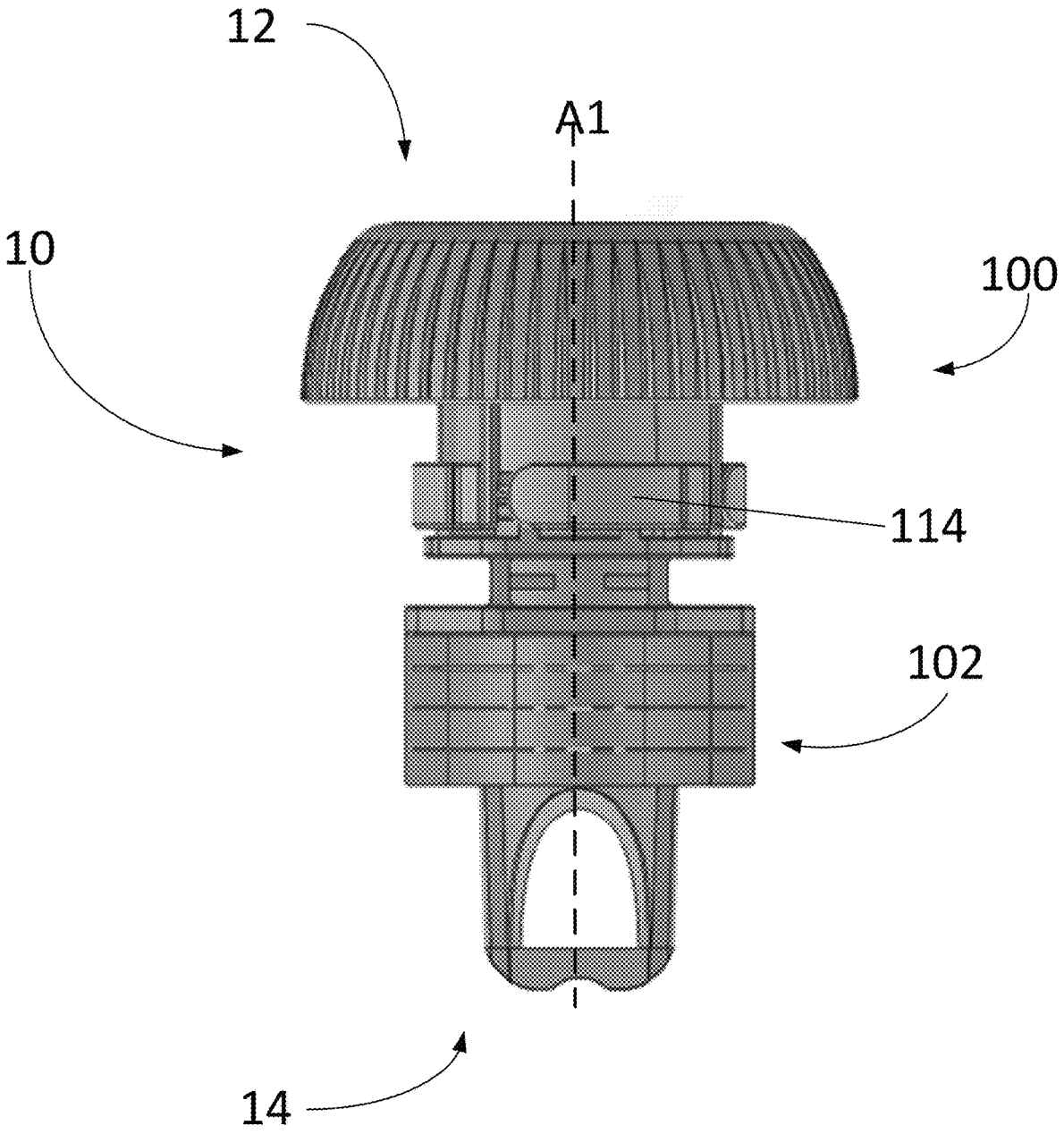
FIG. 2A schematically shows the tamper evident device in accordance with illustrative embodiments of the invention.

FIG. 2A schematically shows the tamper evident device 10 in accordance with illustrative embodiments of the invention. The device shown in FIG. 2A is in a sealed configuration, i.e., the original seal between the straw 102 and the cap 100 is not broken. In the sealed configuration, the device 10 can visually be inspected to confirm that the seal is not broken. In particular, that one or more tamper evident tabs 114 are not broken. The cap 100 is configured to provide a visible indication to a user when the container 8 has been unsealed, opened, or otherwise tampered with. Together, the cap 100 and the straw 102 form a device 10 having a proximal end 12 and a distal end 14 relative to a longitudinal axis A1 of the device 10.

Figure 2B:
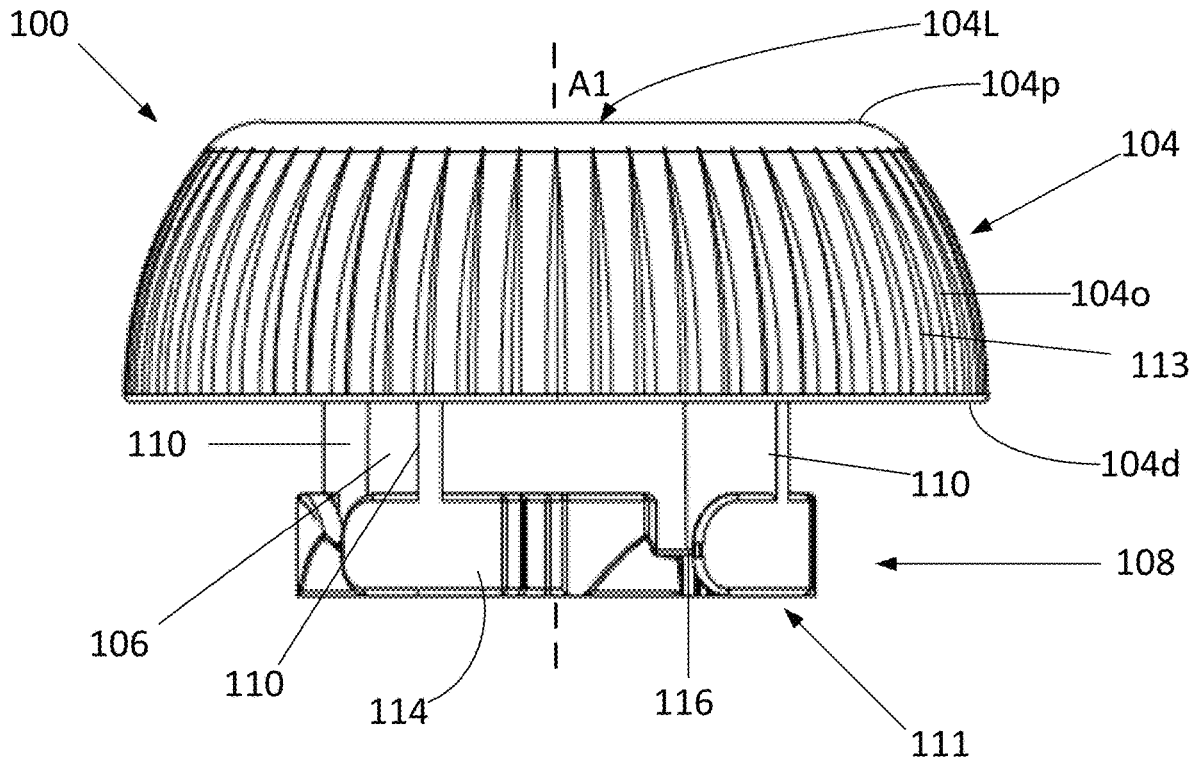
FIG. 2B schematically shows a side view of the cap in accordance with illustrative embodiments of the invention FIG. 2C schematically shows a bottom perspective view of the cap of FIG. 2B.

FIG. 2B schematically shows a side view of the cap 100 in accordance with illustrative embodiments of the invention. As shown in FIG. 2A, the cap 100 seals or closes the container 8. In various embodiments, the cap 100 has an outer shell 104, an inner cap body 106, and one or more tamper-evident bands 108. One or more ribs 110 extend between the inner cap body 106 and the outer shell 104. The tamper-evident band 108 encircles or surrounds at least a portion of the inner cap body 106 and can be formed at, or adjacent to, a distal end 111 of the one or more ribs 110. As discussed in detail below, the tamper-evident band 108 can include one or more tamper-evident tabs 114 (e.g., between ribs 110).

In various embodiments the tamper-evident tabs 114 may substantially surround the cap 100. Each tamper-evident tab 114 can include a tab or flag 114 and a break segment 116. The tamper-evident band 108 is formed such that rotation of the outer shell 104 relative to the straw 102 causes one or more of the tamper-evident tabs 114 to deform and pivot about one of the ribs 110 in a manner visible to a user. The tabs 114 of the present disclosure can be constructed to clearly indicate to a user that the cap 100 has been opened or tampered with. For example, and as discussed in detail further below, caps 100 of the present disclosure can include tabs 114 having a height, as measured along the central longitudinal axis A1, that can be a larger percentage of a height of the outer shell 104 than currently available caps.

The outer shell 104 can have a proximal end 104*p* and a distal end 104*d* with a central lumen 104L extending therebetween. An outer surface 1040 of the outer shell 104 can be gripped by a user and rotated to open the cap 100. In some embodiments, the outer surface 1040 of the outer shell 104 can include one or more features that can aid a user in gripping the cap 100. For example, the outer shell 104 can have a convex profile and/or can include gripping features such as ridges or grooves 113. The distal end 104*d* of the outer shell 104 can terminate proximal to the tamper-evident tab 114 such that the entirety of the tamper-evident tab 114 can be visible to a user.

In some embodiments, the height of the tab 114 can be about, or greater than, $1/6^{th}$ of the height of the outer shell 104, as measured from the proximal end 104*p* to the distal end 104*d* of the outer shell 104 along the proximal-distal axis A1. Accordingly, illustrative embodiments have a 6:1 ratio, or smaller (e.g., 5.5:1, 4:1, 3:1, 2:1, 1:1), of height of the outer shell to the height of tab 114. The inventors have found that this relatively large tab height (as compared to outer shell height) advantageously provides ease of visualization for tamper evidence. Various embodiments and the relative heights of the tab 114 relative to other components of the cap 100 are described in U.S. patent application Ser. No. 16/855,939, filed Apr. 22, 2020, which is incorporated herein by reference in its entirety.

Figure 2C:
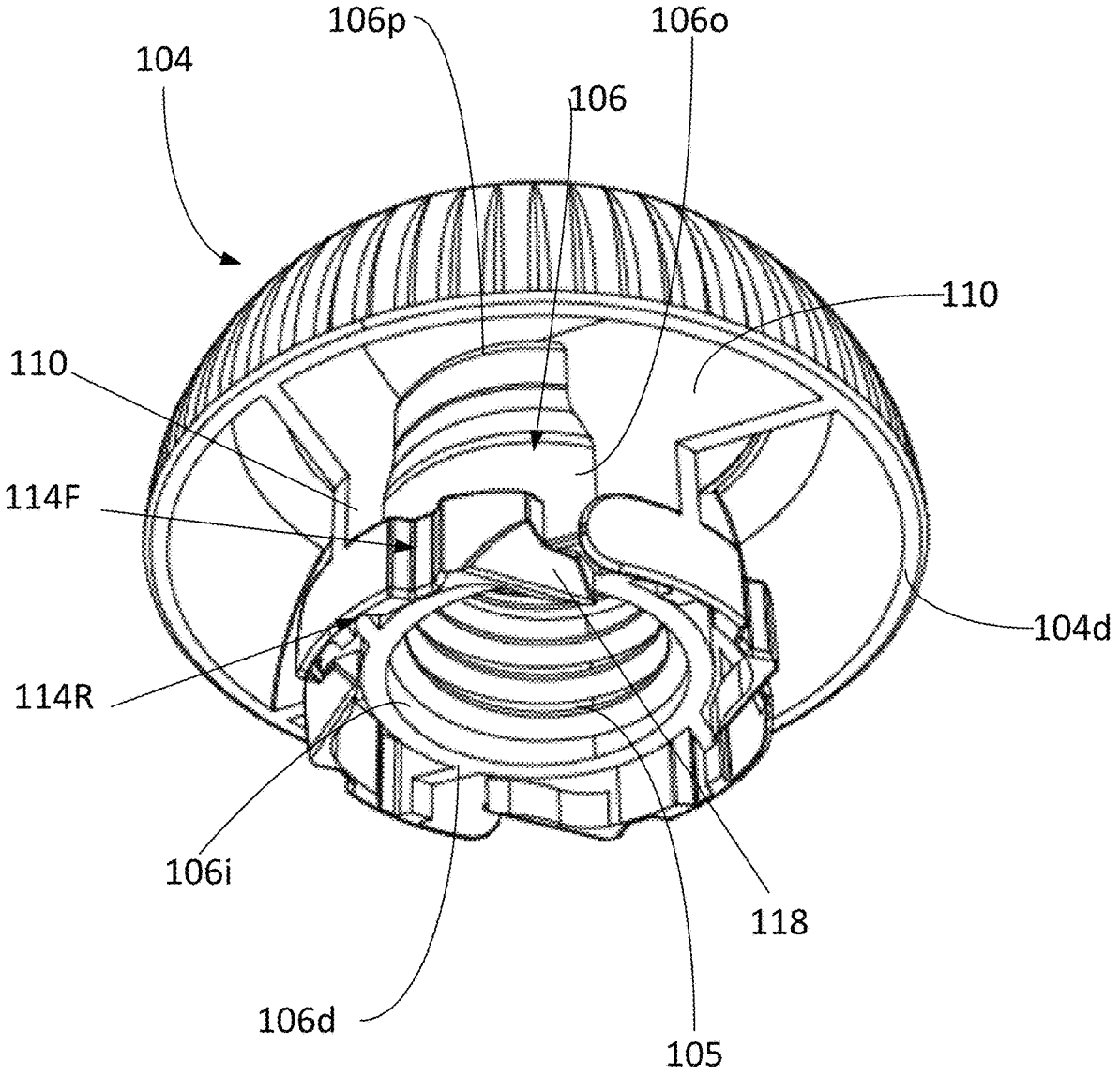
FIG. 2D schematically shows a top view of the cap of FIG. 2C.

FIG. 2C schematically shows a bottom perspective view of the closure of FIG. 2B. The inner cap body 106 may be at least partially located within the outer shell 104. The inner cap body 106 extends from a proximal end 106 *p* to a distal end 106 *d* and may have a substantially cylindrical shape. In various embodiments, the distal end 106 *d* may extend distally beyond the distal end 104 *d* of the outer shell 104. The inner cap body 106 securely couples the cap 100 with the straw 102 (e.g., using internal threads 105 or projections configured to engage external threads or projections on the straw 102). For example, an inner surface 106) of the inner cap body 106 may include threads 105 configured to engage counterpart threads (not shown) on the straw 102. Alternative secure connection mechanisms between the inner cap body 106 and the straw 102 also fall within the scope of the present disclosure.

One or more ribs 110 extend between the inner cap body 106 and the outer shell 104. Each rib 110 can be rigid and can extend vertically (e.g., parallel to the central longitudinal A1). The ribs 110 may have a proximal portion that couples with the outer shell 104. The ribs 110 may also have a distal or terminal portion coupled with the tab 114 and/or break segment 116. While the illustrated embodiment of the cap 100 includes four ribs 110, one skilled in the art understands that the cap 100 of the present disclosure may have a greater or fewer number of ribs 110. The one or more ribs 110 can extend radially outward from an outer surface 1060 of the inner cap body 106 to an inner surface of the outer shell 104. In some embodiments, each rib 110 can extend along the inner surface 104*i* of the outer shell 104 from the proximal end 104*p* to the distal end 104*d* of the outer shell.

Figure 2D:
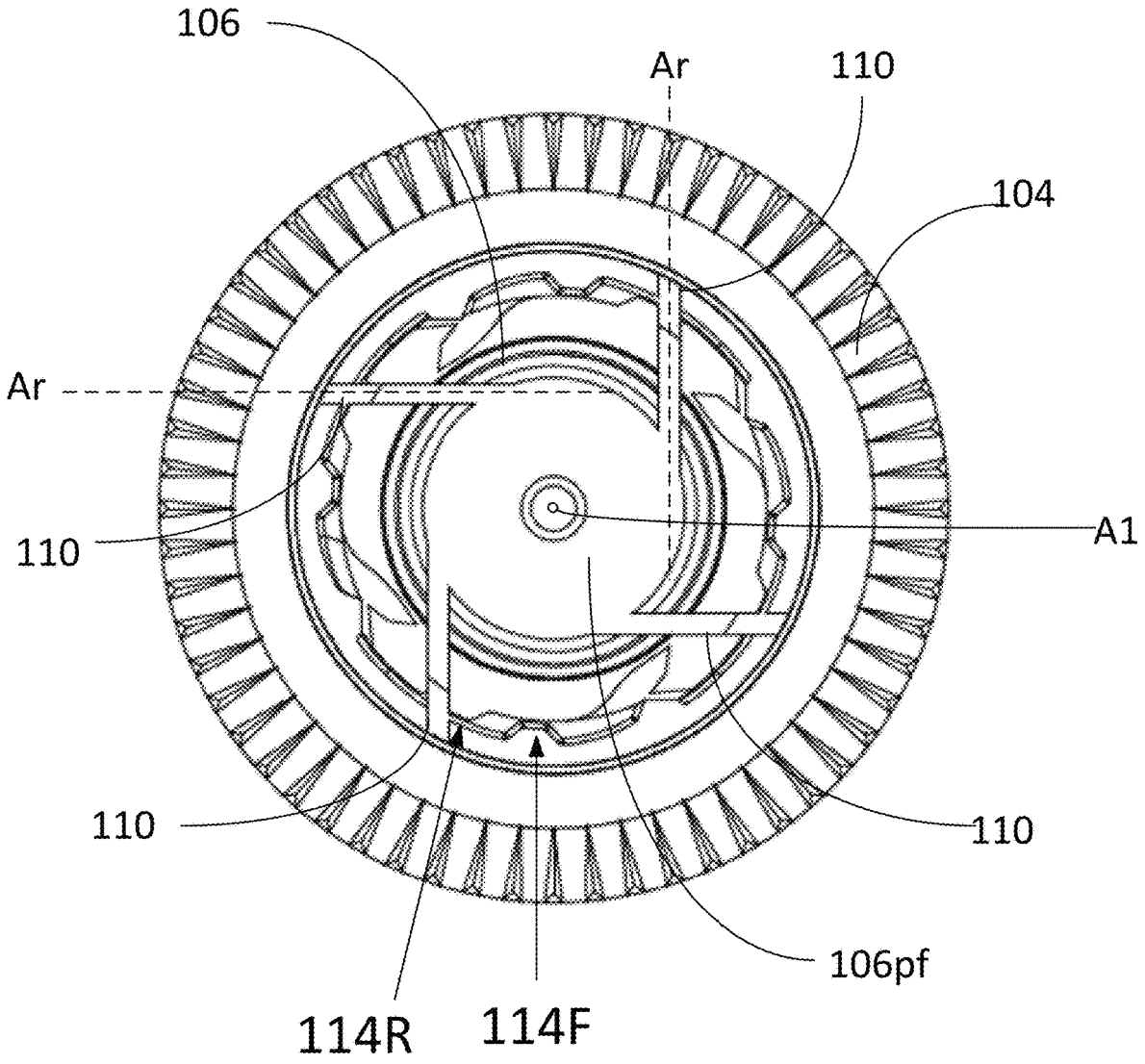

FIG. 2D schematically shows a top view of the cap 100 of FIG. 2C. In various embodiments, a proximal facing surface 106*pf* of the inner cap body 106 has a circular shape. Each of the ribs 110 extends between the outer shell 104 and the inner cap body 106. The ribs 110 may extend substantially at a tangent to the proximal facing surface 106*pf* of the inner cap body 106. Although shown extending at a tangent, the ribs may also extend radially outward from the proximal facing surface 106*pf* (e.g., in a cross-like orientation), or in any other suitable orientation. As shown in the figure, the ribs 110 may extend in the proximal direction beyond the proximal facing surface 106*pf*. Regardless of the shape of the proximal facing surface 106*pf*, the ribs 110 may be offset from the central longitudinal axis A1 (e.g., an axis Ar of the rib 110 does not intersect with the central longitudinal axis A1 of the cap 100). In other words, the ribs 110 may be substantially parallel to a plane including the central longitudinal axis A1. This contrasts with some other embodiments, where the rib axis Ar may with a plane that includes the central longitudinal axis A1.

FIGS. 3A-3E schematically show various views of the straw 102 in accordance with illustrative embodiments.

Figure 3A:
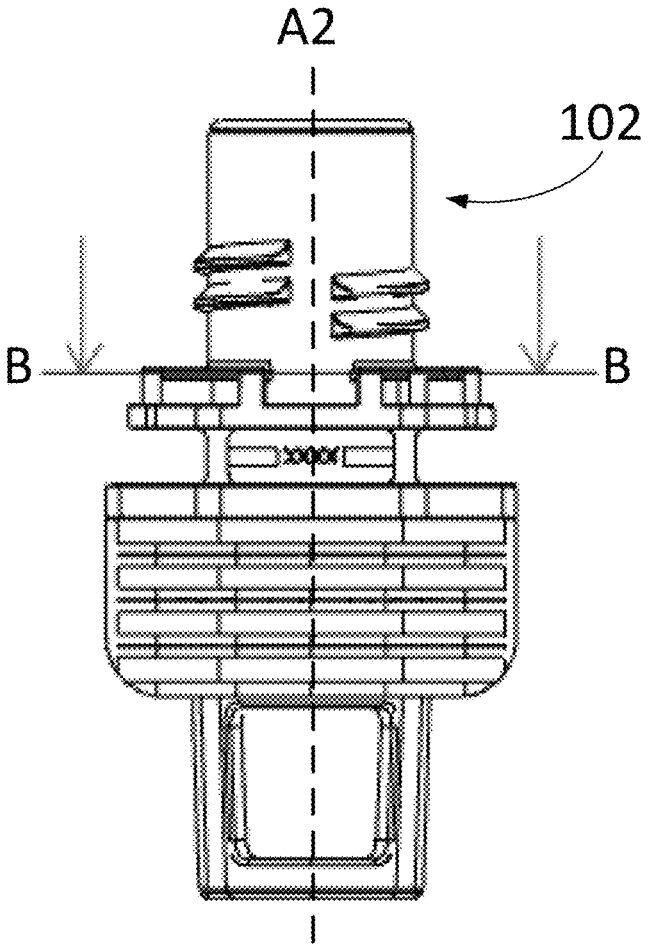
FIGS. 3A-3E schematically show various views of the straw in accordance with illustrative embodiments.
Figure 3B:
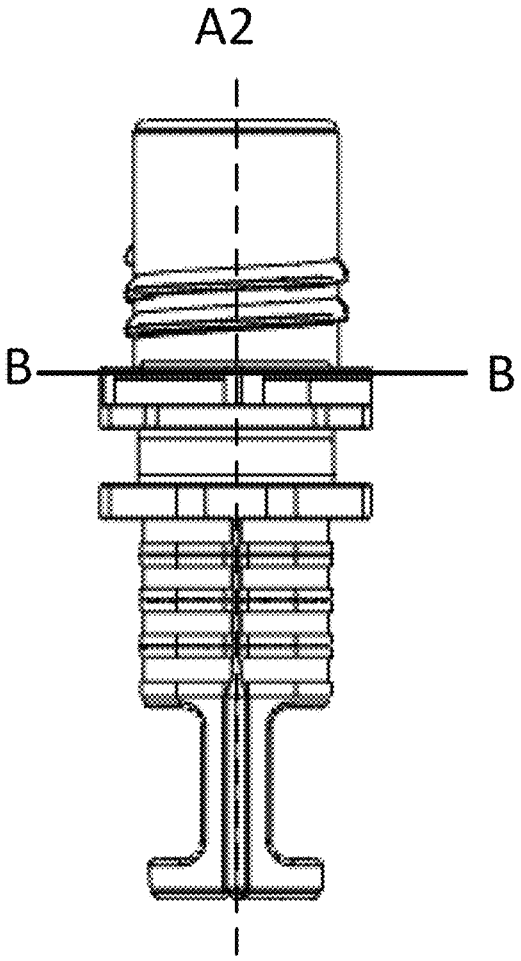
Figure 3C:
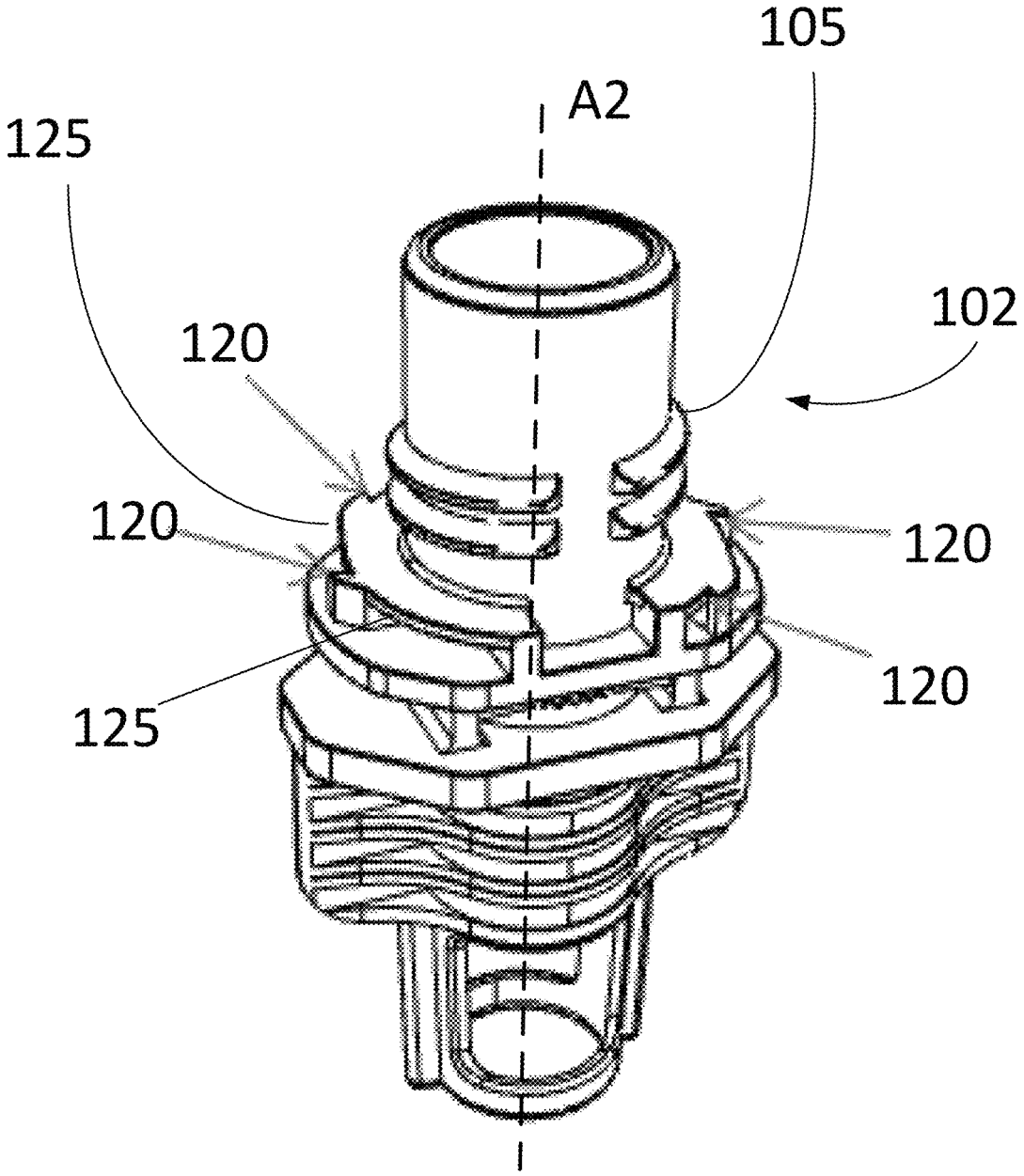

FIGS. 3A and 3B schematically show the straw 102 in accordance with illustrative embodiments of the invention. FIGS. 3A and 3B are two different views of the straw 102 rotated 90 degrees around a central longitudinal axis A2 of the straw 102. The straw 102 is shown in isolation, without the cap 100, and without the container 8. The straw 102 may have threads or protrusions that are configured to threadably engage with counterpart threads from the cap 100. Accordingly, by rotating the cap 100 relative to the straw 102, or vice-versa, the cap 100 may be unsealed and then removed from the straw 102. When the device 10 is unsealed, the tamper evident tabs 114 of the cap 100 are engaged and swing out. As best seen in FIG. 3C, the straw 102 includes one or more projections 120 configured to interact with the tab 114 of the cap 100 and to cause the tab 114 to swing outwardly when the seal is broken. In various embodiments, the projections 120 may be located on a plane defined by the line B-B.

FIG. 3C schematically shows a perspective view of the straw 102 of FIGS. 3A and 3B. The straw 102 includes the one or more projections 120 that are configured to interact with the cap 100 (e.g., with the lugs) to cause the tabs 114 to swing outwardly. In this example, the straw 102 includes four projections 120. However, it should be understood that various embodiments may have one or more projections 120. The projections 120 may be interspersed along an otherwise smooth or slidable outer edge 125 (also referred to as outer surface 125).

Figure 3D:
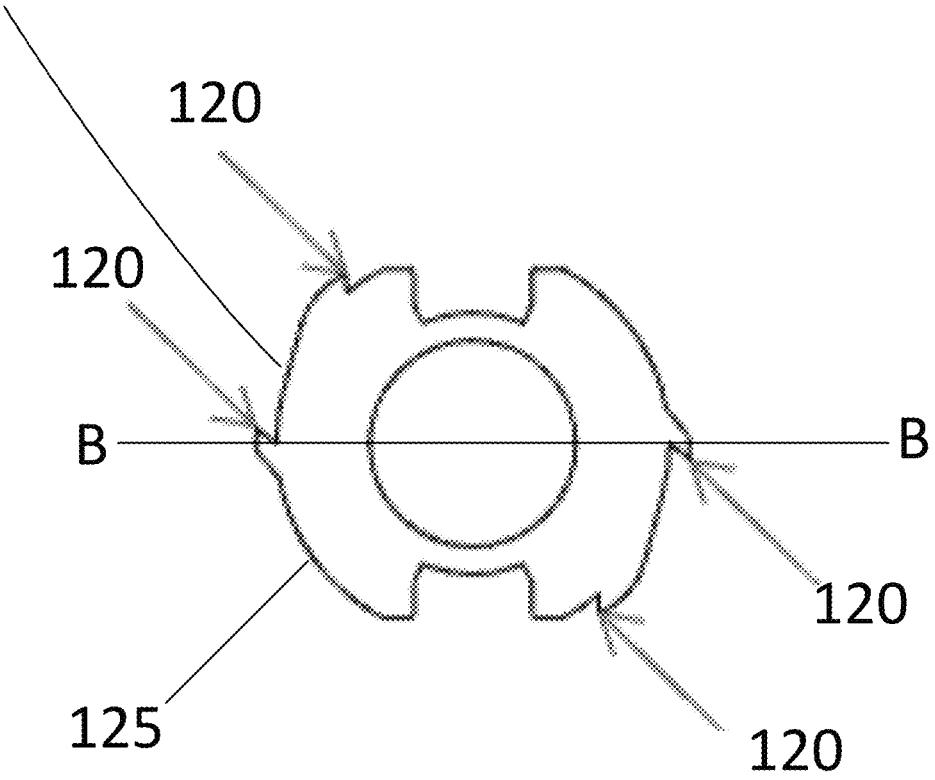
Figure 3E:
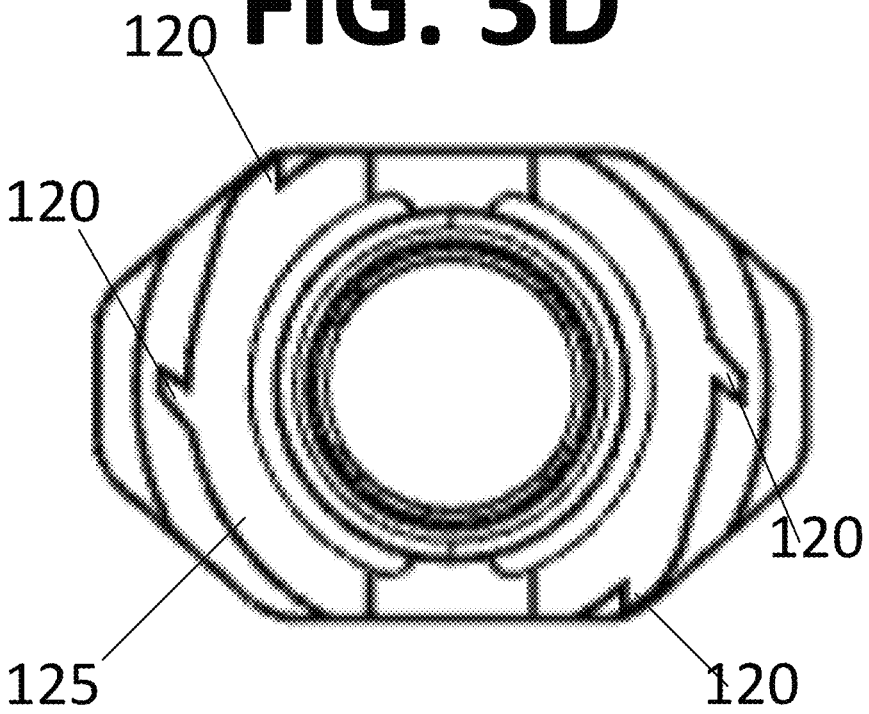

FIG. 3D schematically shows a cross-sectional view along plane B-B shown in FIGS. 3A and 3B in accordance with illustrative embodiments. The straw 102 has a relatively smooth outer edge 125. The internal features of the cap 100 may slide along the smooth outer edge 125 as the cap 100 rotates relative to the straw 102 (e.g., when the cap 100 is unthreaded from the straw 102). However, the internal features of the cap 100 (e.g., lugs) may engage with projections 120 extending radially outwardly from the outer edge 125. FIG. 3E schematically shows a top view of the straw 102 in accordance with illustrative embodiments.

Figure 4A:
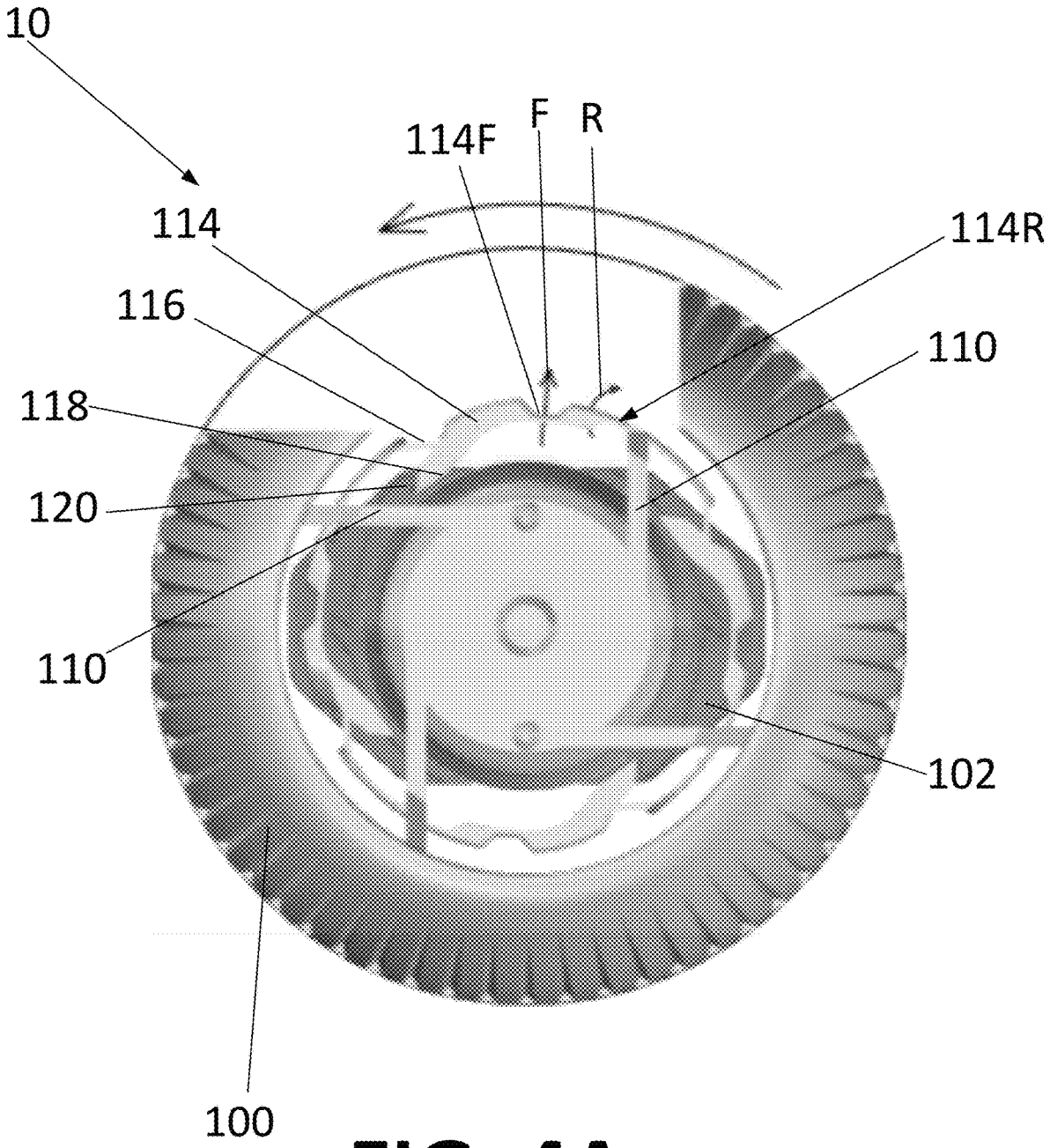
FIGS. 4A to 4C schematically show a partial cutaway view of the cap coupled with the straw in accordance with illustrative embodiments of the invention.
Figure 4B:
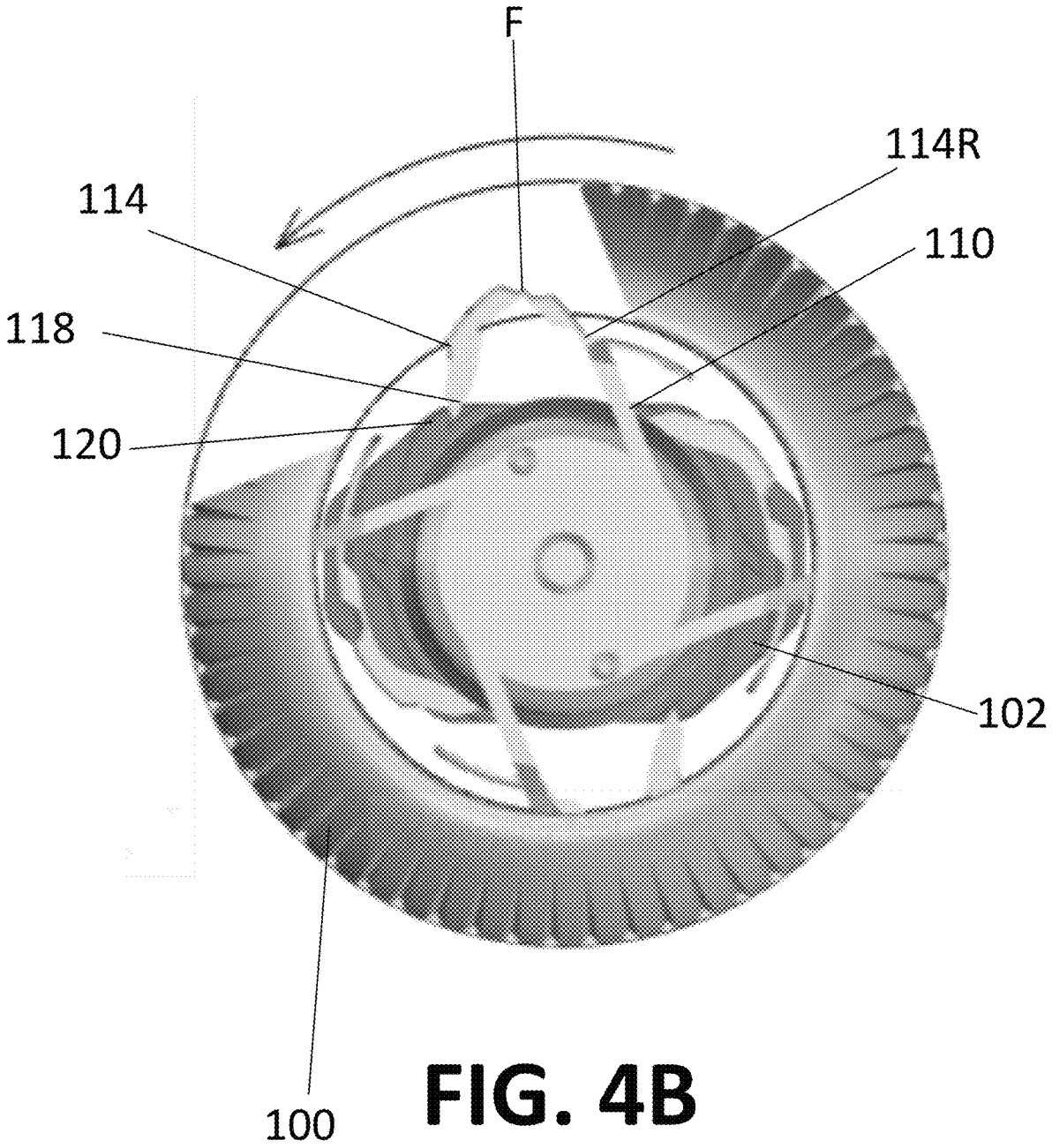
Figure 4C:
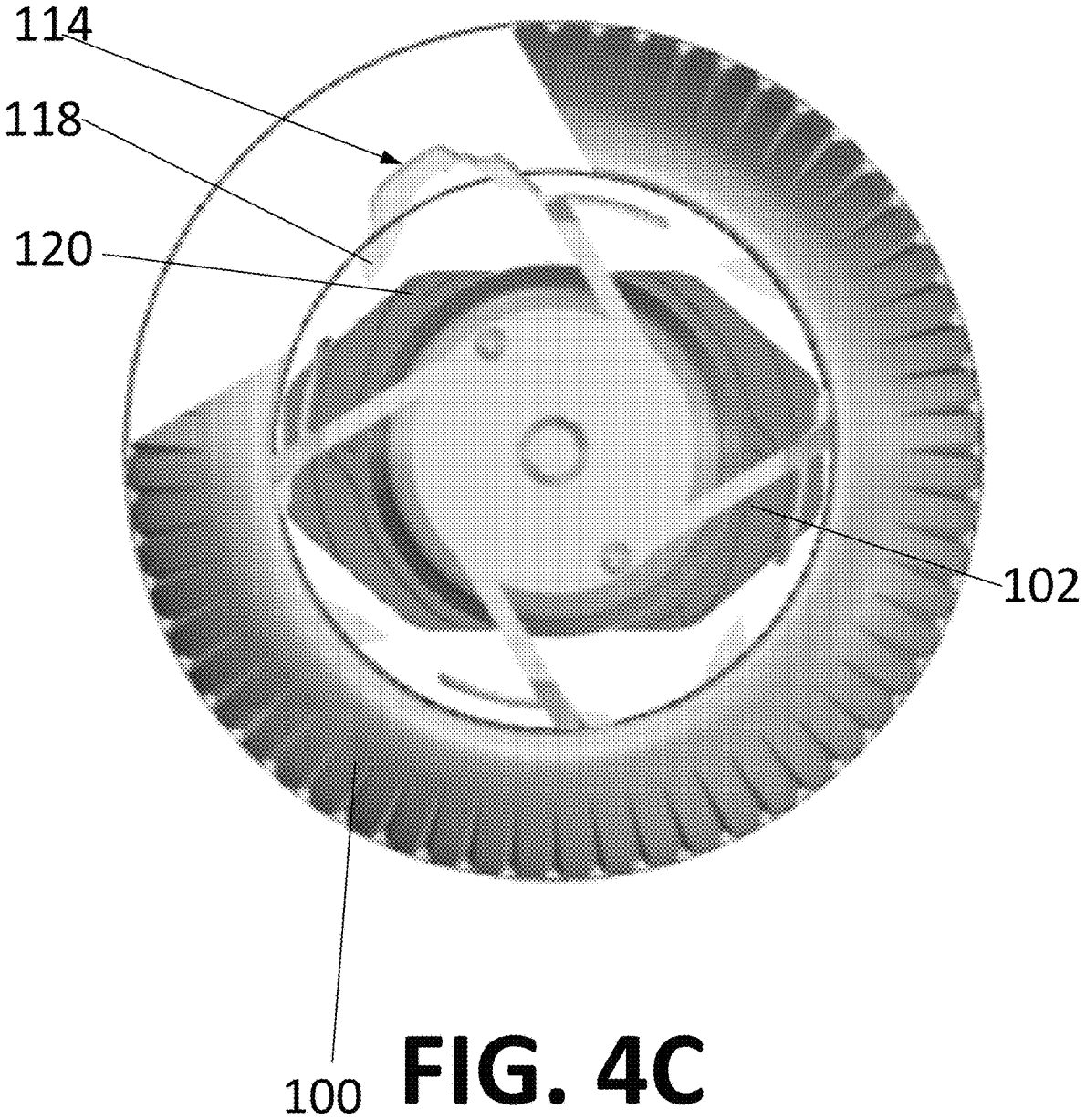

FIGS. 4A to 4C schematically show a partial cutaway view of the cap 100 coupled with the straw 102 in accordance with illustrative embodiments of the invention. In FIG. 4A the cap 100 is rotated relative to the straw 102 in a counter-clockwise direction (although other embodiments may be configured to open when the cap 100 is rotated in a clockwise direction). The tab 114 of the cap 100 may be coupled, directly or indirectly, with one or more ribs 110 integrally molded with the cap 100.

The tab 114 includes an inwardly projecting lug 118 configured to engage with the projection 120 as the cap 100 is rotated. When the lug 118 and the projection 120 contact one another (i.e., engage one another), the user encounters resistance while turning the cap 100. When the user applies sufficient force, the engagement between the lug 118 and the projection 120 causes the tab 114 to fold, rotate, and/or swing out (as shown in FIG. 4B).

The tab 114 is configured to swing outwardly when the seal between the cap 100 and the straw 102 is broken. Accordingly, the tab 114 has at least one hinge 114R configured to rotate R the tab relative to a first rib 110 when the seal is broken. Additionally, or alternatively, various embodiments have a foldable portion 114F configured to fold F the tab 114 when the seal is broken. In various embodiments, the fold F and the rotation R may both be effectuated using a thinned portion of the tab 114 that is configured to operate as a hinge 114R. In various embodiments, the hinge 114R is adjacent to and/or in contact with the rib 110.

For the tab 114 to rotate R outwardly, in some embodiments, the bridge 116 breaks. The bridge 116 holds the tab 114, either directly or indirectly, to a second rib 110. In various embodiments, the bridge 116 is configured so that the force normally applied by a user to unseal the device 10 (i.e., to overcome the engagement between the lug 118 and the projection 120) is sufficient to break the bridge 116. When the lug 118 engages with the projection 120, the lug 118 no longer rotates because of interference with the projection 120. Thus, continued application of force by the user (e.g., in the counter-clockwise direction) causes the bridge 116 to fracture, and the tab 114 to fold F at the foldable portion 114F. However, some embodiments may not include the bridge 116.

FIG. 4B schematically shows the device 10 of FIG. 4A after the bridge 116 is broken and the tab 114 folds in accordance with illustrative embodiments. As shown, the tab 114 folds at the fold F and rotates relative to the first rib 110 at the hinge 114R. Thus, the tab 114 swings outwardly to visually indicate that the seal (e.g., the bridge 116) is broken. The lug 118 and the projection 120 may continue to be in contact, although with considerably less resistance, until the cap 100 is rotated further.

FIG. 4C schematically shows the device 10 of FIG. 4B visually indicating that the seal is broken in accordance with illustrative embodiments of the invention. FIG. 4C schematically shows the device 10 of FIG. 4B rotated further in the opening direction (e.g., in the counter-clockwise direction). In various embodiments, as the cap 100 is rotated further, the lug 118 disengages from the projection 120. The tab 114 thus remains in a outwardly swung position regardless of the rotation of the cap 100. Accordingly, users may now visually identify that the container 8 has been tampered with or opened.

Figure 5:
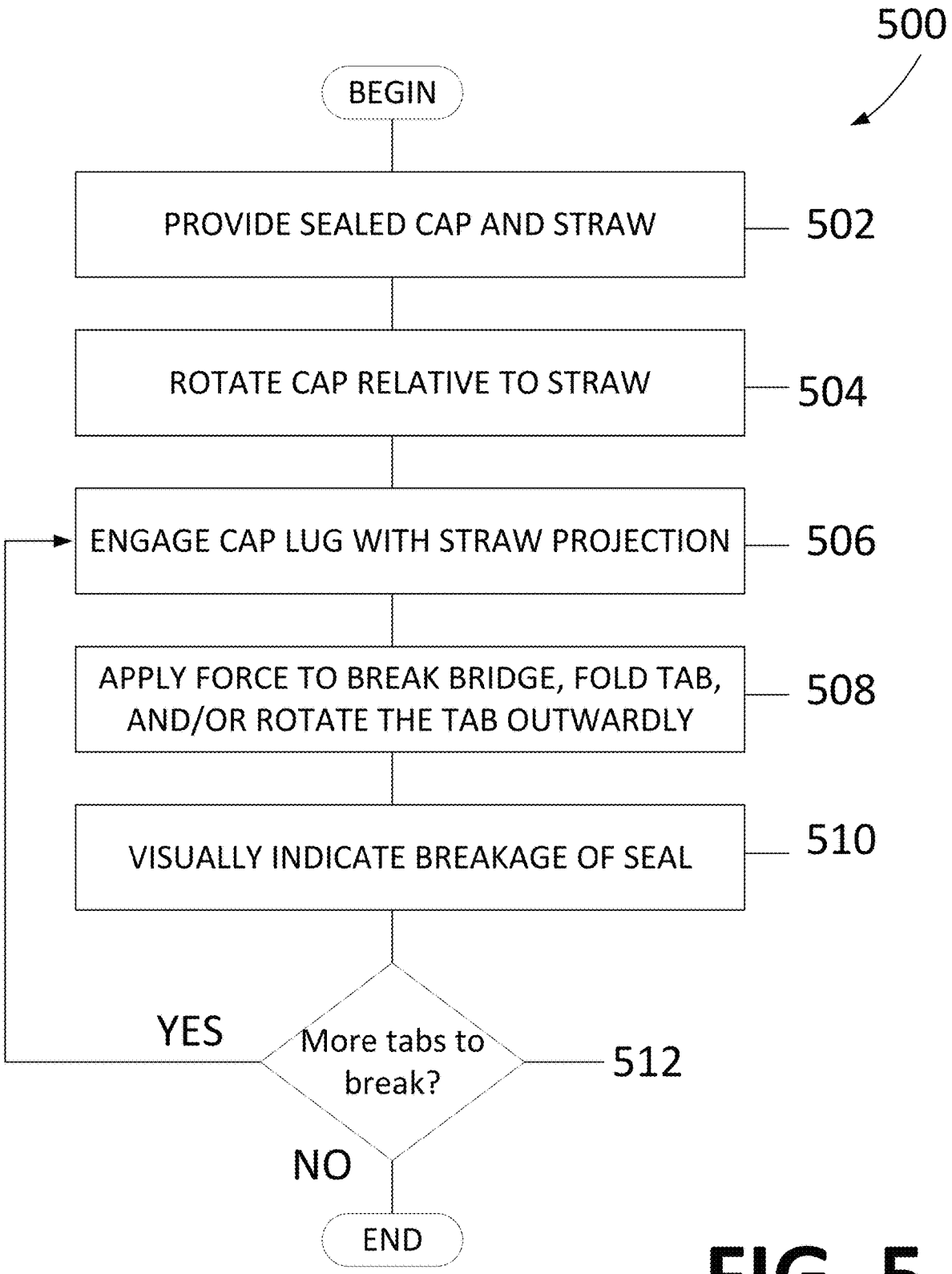
FIG. 5 schematically shows a process of providing a visual indication that the device has been tampered with in accordance with illustrative embodiments of the invention.

FIG. 5 schematically shows a process 500 of providing a visual indication that the device 10 has been tampered with in accordance with illustrative embodiments of the invention. In the context of the present application, tampering with the device 10 means breaking a seal of the device 10 (i.e., between the cap 100 and the straw 102). Phrased another way, the device 10 provides a visual indication that the device has been transitioned from a sealed configuration to an unsealed configuration.

It should be noted that this method is substantially simplified from a longer process that may normally be used. Accordingly, the method shown in FIG. 5 may have many other steps that those skilled in the art likely would use. In addition, some of the steps may be performed in a different order than that shown, or at the same time. Furthermore, some of these steps may be optional in some embodiments. Accordingly, the process 500 is merely exemplary of one process in accordance with illustrative embodiments of the invention. Those skilled in the art therefore can modify the process as appropriate.

The process begins at step 502, which provides a sealed device 10, i.e., the cap 100 sealed with the straw 102. During use, the sealed device 10 is also joined with the container 8, as shown in FIG. 1. Among other things, the container 8 may include a pre-made spouted pouch. The pouch may advantageously include a sealed-in, easy flow straw 102 coupled with a re-closeable, tamper-evident cap 100 as described in various embodiments. The pouch 8 may be commercially available in a wide variety of shapes, sizes, and materials. The container 8 may be a spouted or flat pouch, and may be used for all types of liquid and viscous food and non-food products across a range of processes that include hot fill, retort, cold/ambient fill, and high-pressure processing. In various embodiments, the sealed device 10 may be joined with the container 8 having contents for a user therein.

The process then proceeds to step 504, which rotates the cap 100 relative to the straw 102 to unseal the device 10. This step may be performed, for example, by a customer or end-user. Alternatively, it may be performed by some bad actor who is trying to access the contents of the container 8.

Figure 6A:
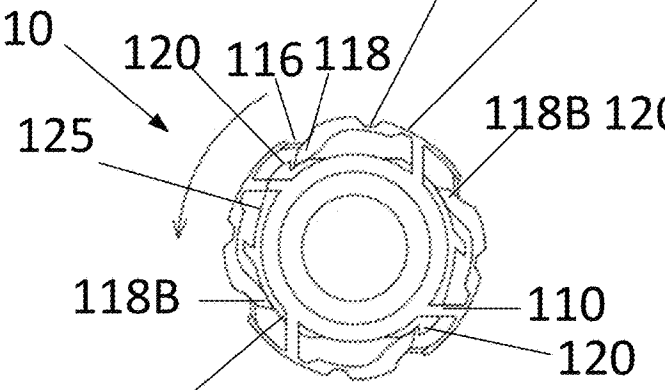
FIGS. 6A-6C schematically show a partially exposed top view of the device, the cap, and the straw, respectively, in a sealed configuration in accordance with illustrative embodiments of the invention.
Figure 6B:
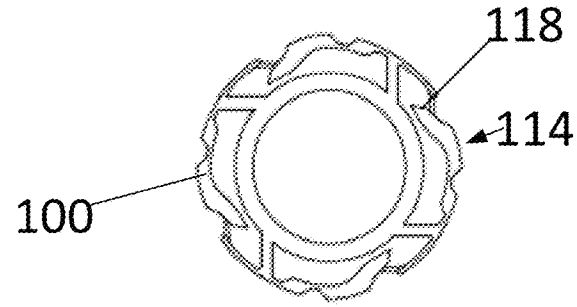
Figure 6C:
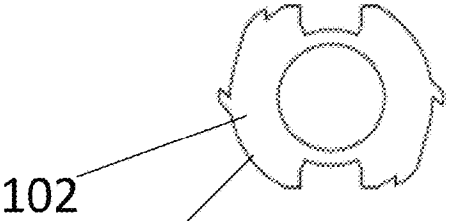

FIGS. 6A-6C schematically show a partially exposed top view of the device 10, the cap 100, and the straw 102, respectively, in a sealed configuration in accordance with illustrative embodiments of the invention. In particular, FIG. 6B schematically shows the cap 100 in an isolated view in the sealed configuration. FIG. 6C schematically shows the straw 102 in an isolated view in the sealed configuration. The device 10 is configured so that the lug 118 of the cap 100 moves (e.g., slides) along the outer edge 125 of the straw 102. In some embodiments, the edge 125 may be smooth and/or may be sized so that the lug 118 is not prevented from rotating. In contrast, the projection 120 is configured to engage with the lug 118 to prevent further rotation of the lug 118 without unsealing the device 10 (i.e., breaking or otherwise modifying the tab 114).

It should be apparent that although various embodiments refer to a tab 114, a lug 118, a projection 120, and other components in the singular, that various embodiments may have one or more of these items. In the illustrative embodiment shown in FIGS. 6A-6C, for example, there are four tabs 114, each having a respective lug, and there are four projections 120 on the straw 102.

It should further be noted that some embodiments are configured to unseal when rotated in a first direction (e.g., counter-clockwise), but not when rotated in a second direction (e.g., clockwise). For example, in the example of FIG. 6A, the device is opened/unsealed when the cap 100 is rotated counter-clockwise relative to the straw 102. Some embodiments may have features configured to prevent the cap 100 from rotating clockwise. Alternatively, the cap 100 may rotate clockwise without opening/unsealing the device 10. For example, the lug 118 may slide up and over the projection 120 when rotated clockwise, while the tab 114 flexes without the bridge 116 breaking and/or without the tab 114 folding.

Figure 9A:
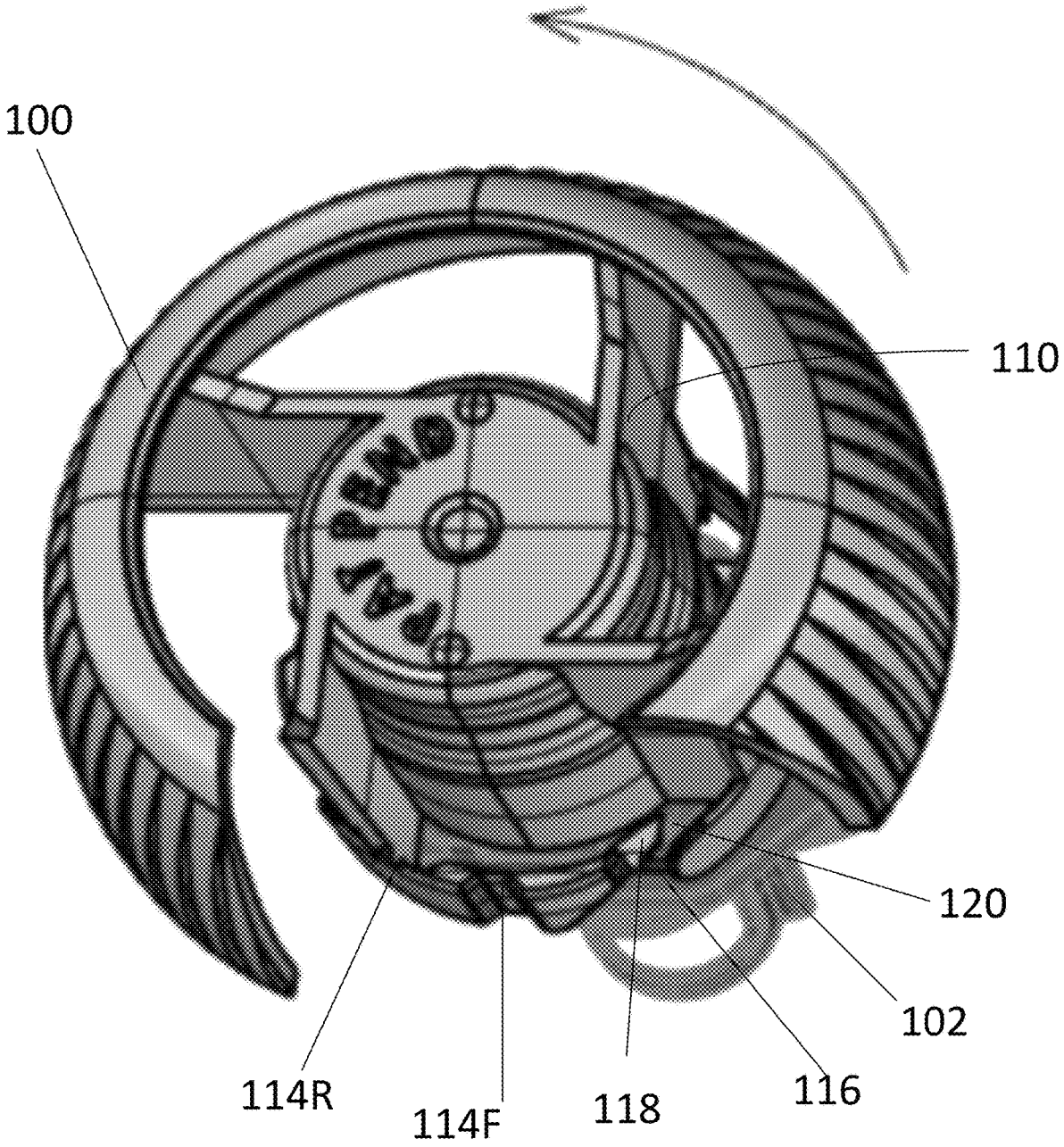
FIG. 9A schematically shows a partially cut-open perspective view of FIG. 6A.

Returning to the process of FIG. 5, at step 506 the cap 100 is rotated until the lug 118 engages with the projection 120. FIG. 6A shows the lug 118 just before it engages with a respective projection 120. Additionally, two other lugs 118B may be configured to engage with the projections 120 at a later time (i.e., after further rotation). FIG. 9A schematically shows a partially cut-open perspective view of FIG. 6A.

When the lug 118 engages the projection 120, the process 500 proceeds to step 508, which applies sufficient force to transition the device into the unsealed configuration. In various embodiments, this includes breaking the bridge 116, folding the tab 114, and/or rotating the tab 114 around the hinge 114R for the one or more tabs 114. In various embodiments, breaking the bridge 116, folding the tab 114, and/or rotating the tab 114 around the hinge 114R may occur simultaneously or in sequence, based on the configuration of the device 10. Additionally, various embodiments may be tuned to configure the threshold force required to transition the device into the unsealed configuration. However, those skilled in the art will understand that various embodiments require a threshold of force generally used to open sealed containers (e.g., bottle of soda).

Figure 7A:
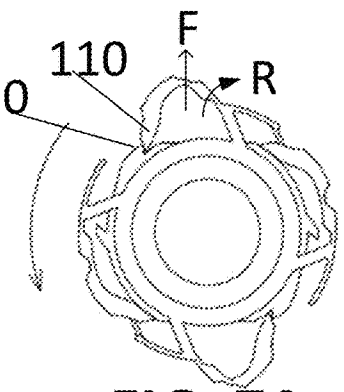
FIGS. 7A-7C schematically show a partially exposed top view of the device, the cap, and straw, respectively, as the seal is broken in accordance with illustrative embodiments of the invention.
Figure 7B:
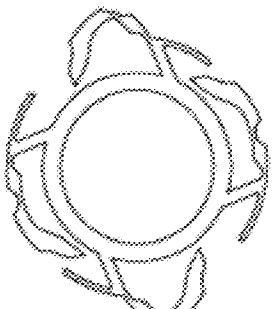
Figure 7C:
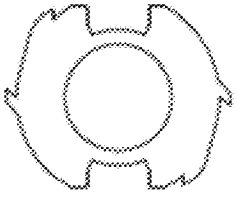
Figure 9B:
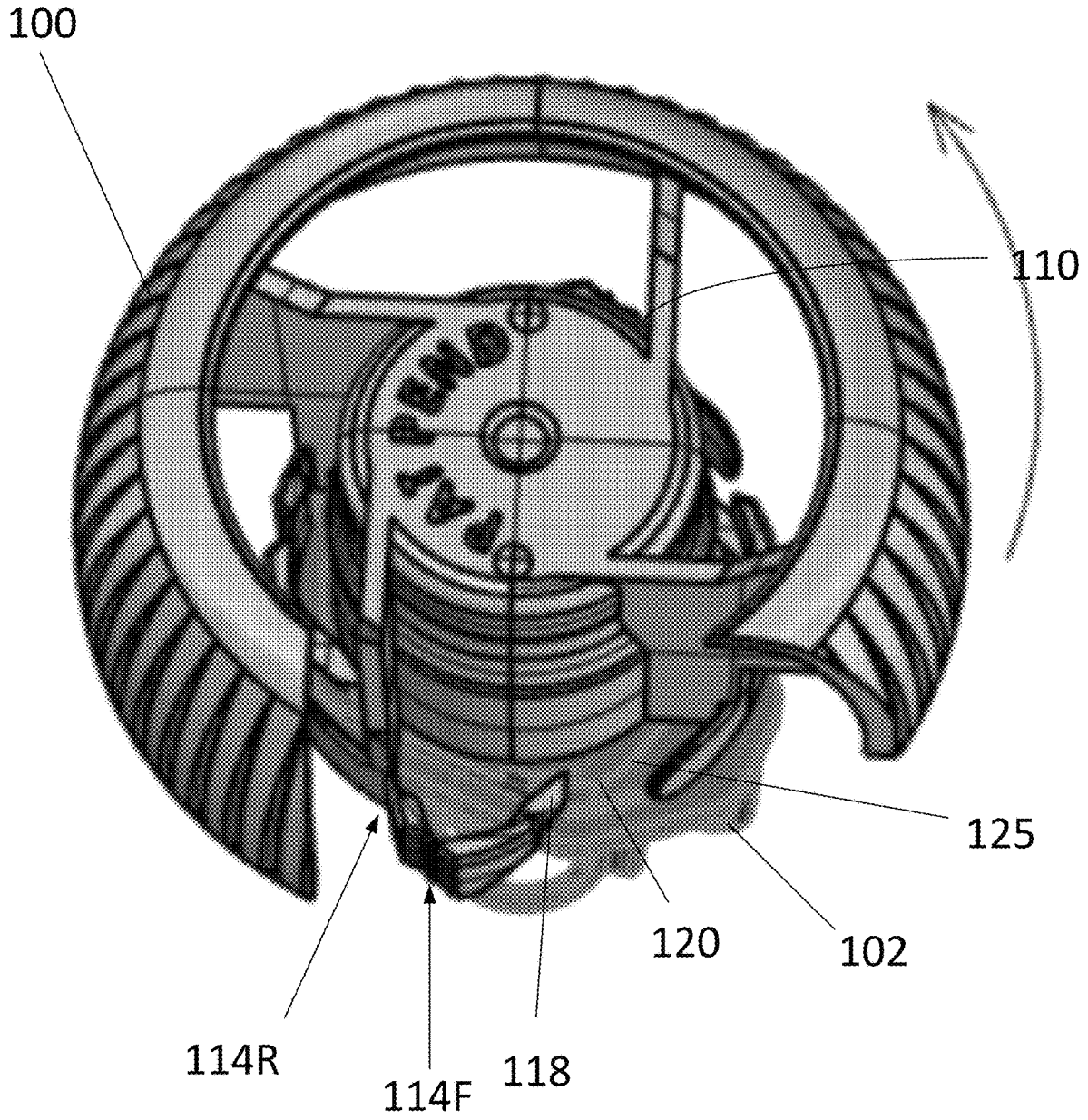
FIG. 9B schematically shows a partially cut-open perspective view of FIG. 7A.

This process may be repeated until all of the tabs 114 are broken, folded, and/or rotated outwardly. FIGS. 7A-7C schematically show a partially exposed top view of the device 10, the cap 100, and straw 102, respectively, as the seal is broken in accordance with illustrative embodiments of the invention. As shown in FIGS. 7A and 7B, the bridge 116 breaks when sufficient rotational force (a "breaking force") is applied by the user to overcome the interference between the lug 118 and the projection 120. In various embodiments, the breaking force causes the tab 114 to fold F along the foldable portion 114F, and/or to rotate R or swing outwardly at the hinge 114R. Some embodiments may have tabs 114 that include one or more of the breakable bridge 116, the foldable portion 114F, and/or the rotating hinge 114R. FIG. 9B schematically shows a partially cut-open perspective view of FIG. 7A.

Figure 8A:
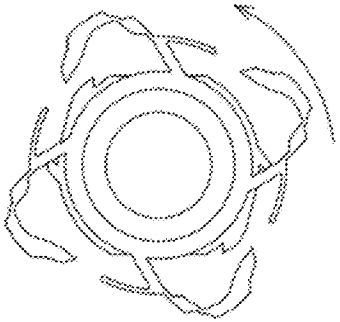
FIGS. 8A-8C schematically show a partially exposed top view of the device, the cap, and straw, respectively, in a visibly tampered configuration in accordance with illustrative embodiments of the invention.
Figure 8B:
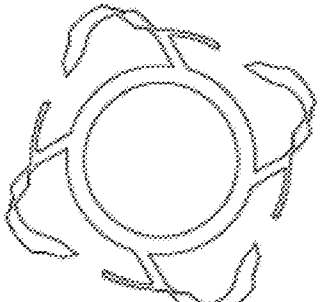
Figure 8C:
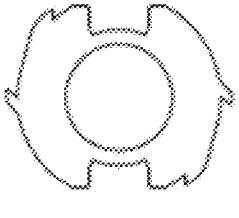
Figure 9C:
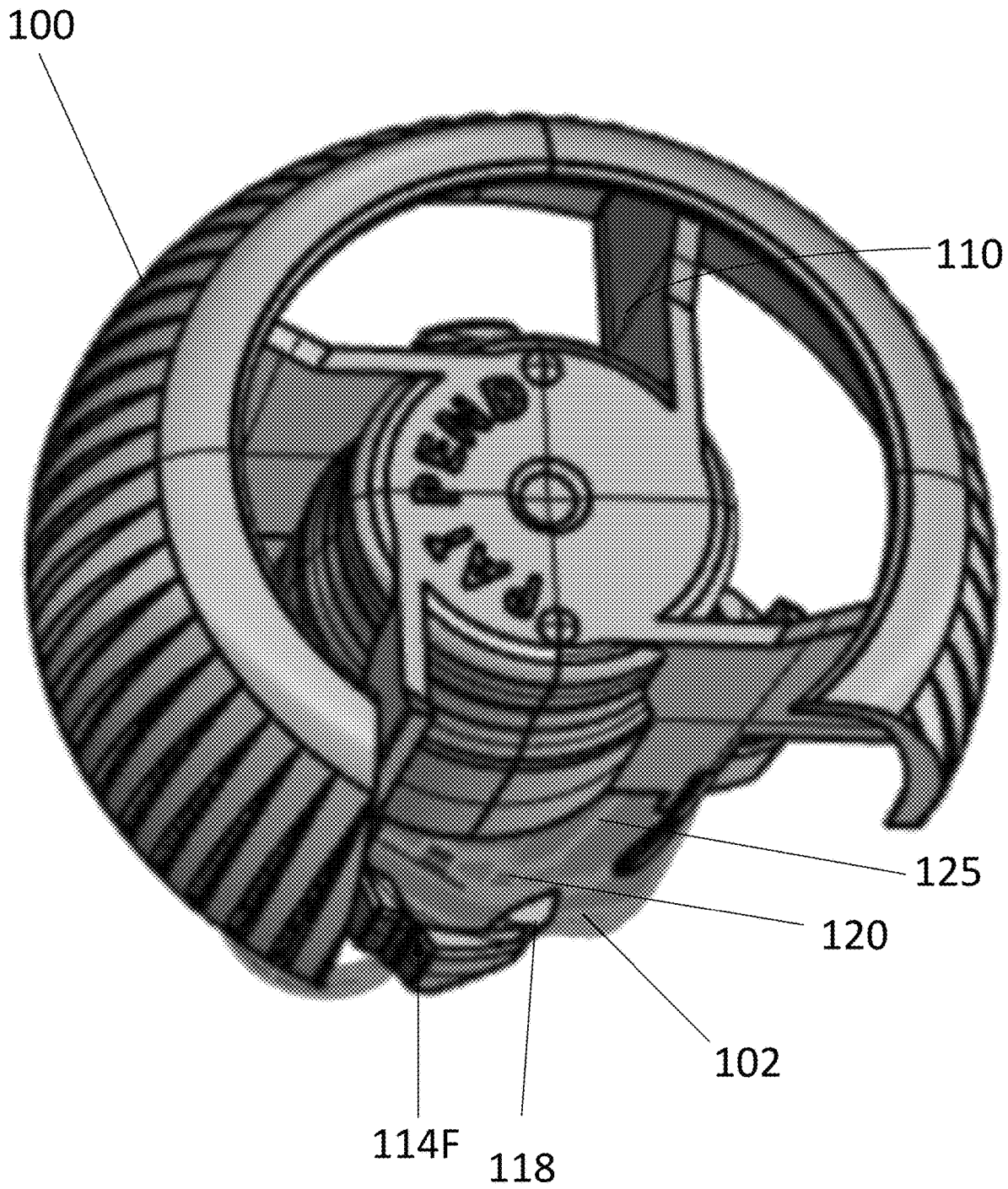
FIG. 9C schematically shows a partially cut-open perspective view of FIG. 8A.

The process then proceeds to step 510, which visually indicates that the seal has been broken to a user. When the tab 114 has rotated outwardly (e.g., around the hinge 114R), the user may clearly see that the device 10 has been tampered with or is in the unsealed configuration. FIGS. 8A-8C schematically show a partially exposed top view of the device 10, the cap 100, and straw 102, respectively, in a visibly tampered configuration in accordance with illustrative embodiments of the invention. In the visibly tampered configuration, the tab swings outwardly, easily alerting any user that the seal is broken, and that the contents with the container 8 may have been accessed. FIG. 9C schematically shows a partially cut-open perspective view of FIG. 8A.

In some embodiments, the process proceeds to step 512, which asks is there are more tabs to break. For example, in some embodiments, only a portion of all of the tabs 114 may be configured to break, rotate, and/or fold at a given time. Accordingly, if there are more tabs to break, rotate, and/or fold, the process may return to step 506, which engages the lug 118 of the given tab 114 with the projection 120. As described previously, steps 508 and 510 are repeated until the tab 114 breaks, rotates, and/or folds. Thus, in some embodiments, step 506 may be repeated (i.e., the cap 100 may be rotated) until all of the lugs 118 have engaged with a projection 120. The process 500 then comes to an end.

Although the process of FIG. 5 is shown and described with reference to a particular style of cap 100, it should be understood that the cap 100 may take on a variety of configurations that are within the scope of illustrative embodiments. For example, FIGS. 10A-14C schematically show an alternative embodiment of the cap in accordance with illustrative embodiments of the invention.

Figure 10A:
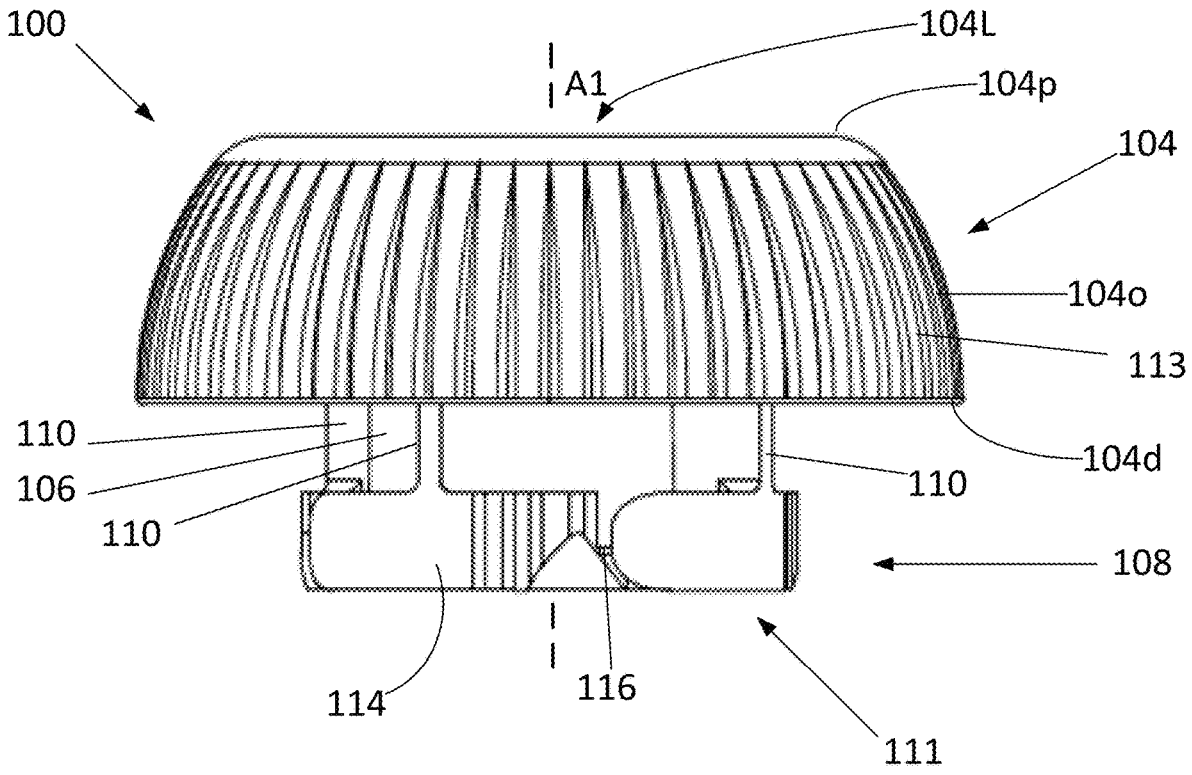
FIG. 10A schematically shows a side view of an alternative embodiment of the cap in accordance with illustrative embodiments of the invention FIG. 10B schematically shows a bottom perspective view of the cap of FIG. 10A.

FIG. 10A schematically shows a side view of an alternative embodiment of the cap 100 in accordance with illustrative embodiments of the invention. As shown in FIG. 2A, the cap 100 can seal or close the container 8. In various embodiments, the cap 100 has the outer shell 104, the inner cap body 106, and one or more tamper-evident bands 108. One or more of the ribs 110 extend between the inner cap body 106 and the outer shell 104. The tamper-evident band 108 encircles or surrounds at least a portion of the inner cap body 106 and can be formed at, or adjacent to, a distal end 111 of the one or more ribs 110. As discussed in detail below, the tamper-evident band 108 can include one or more tamper-evident tabs 114 (e.g., between ribs 110).

In various embodiments the tamper-evident tabs 114 may substantially surround the cap 100. Each tamper-evident tab 114 can include the tab or flag 114 and the break segment 116. The tamper-evident band 108 is formed such that rotation of the outer shell 104 relative to the straw 102 causes the tab 114 of one or more of the tamper-evident tabs 114 to deform and pivot about one of the ribs 110. More particularly, the tab 114 can rotate about the central axis A1 of the rib 110 in a manner visible to a user. The tab 114 of the present disclosure can be constructed to clearly indicate to a user that the cap 100 has been opened or tampered with. For example, and as discussed in detail further below, caps 100 of the present disclosure can include tabs 114 having a height, as measured along the central longitudinal axis A1, that can be a larger percentage of a height of the outer shell 104 than currently available caps.

The outer shell 104 can have a proximal end 104*p* and a distal end 104*d* with a central lumen 104L extending therebetween. An outer surface 1040 of the outer shell 104 can be gripped by the user and rotated to open the cap 100. In some embodiments, the outer surface 1040 of the outer shell 104 can include one or more features that can aid the user in gripping the cap 100. For example, the outer shell 104 can have a convex profile and/or can include gripping features such as ridges or grooves 113. The distal end 104*d* of the outer shell 104 can terminate proximal to the tamper-evident tab 114 such that the entirety of the tamper-evident tab 114 is visible to the user. 25

In some embodiments, the height of the tab 114 is about, or greater than, $1/6^{th}$ of the height of the outer shell 104, as measured from the proximal end 104*p* to the distal end 104*d* of the outer shell 104 along the proximal-distal axis A1. Accordingly, illustrative embodiments have a 6:1 ratio, or smaller (e.g., 5.5:1, 4:1, 3:1, 2:1, 1:1), of height of the outer shell to the height of tab 114. The inventors have found that this relatively large tab 114 height (as compared to outer shell height) advantageously provides ease of visualization for tamper evidence. Various embodiments and the relative heights of the tab 114 relative to other components of the cap 100 are described in U.S. patent application Ser. No. 16/855,939, filed Apr. 22, 2020, which is incorporated herein by reference in its entirety.

Figure 10B:
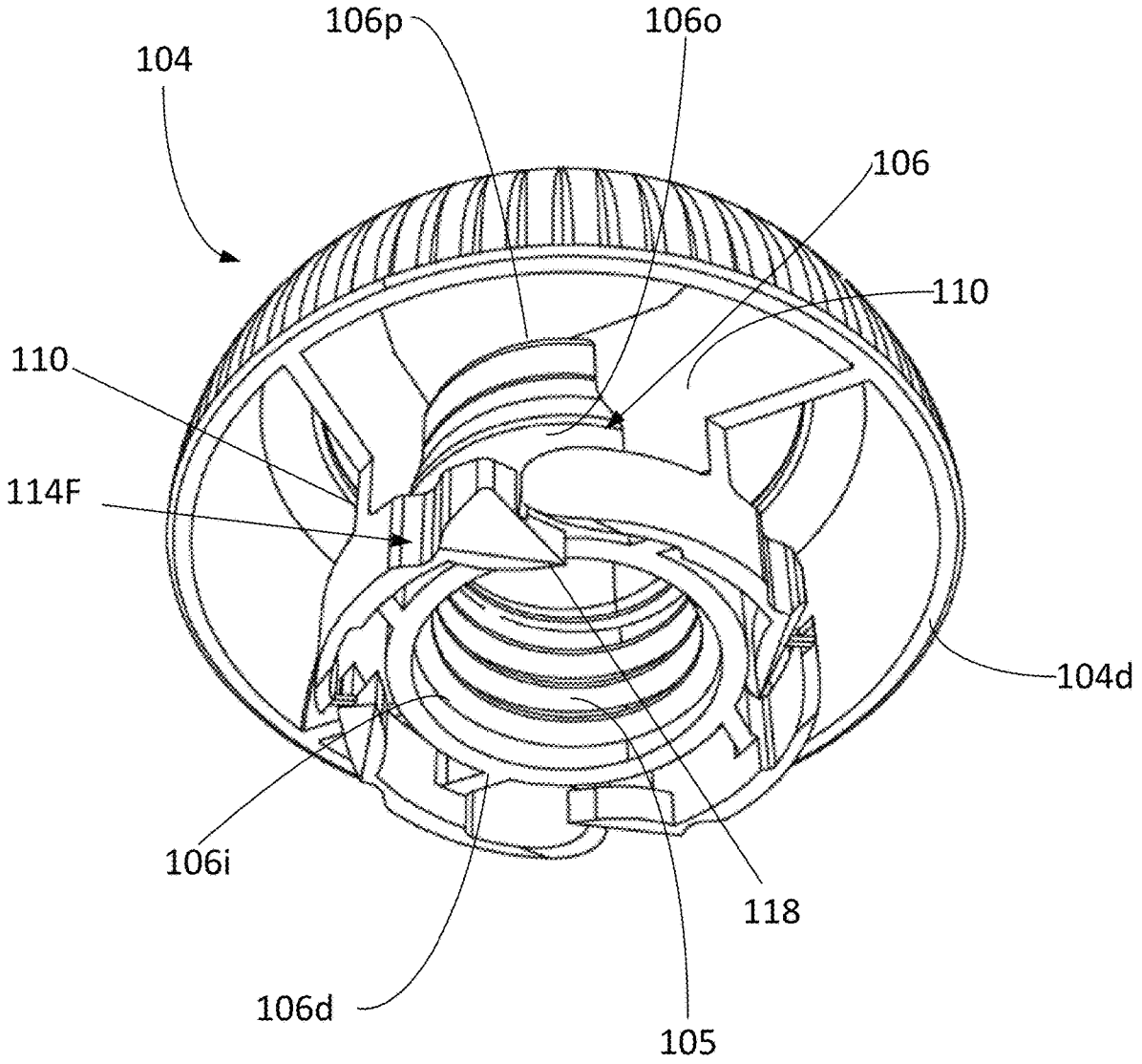
FIG. 10C schematically shows a top view of the cap of FIG. 10B.

FIG. 10B schematically shows a bottom perspective view of the cap 100 of FIG. 10A. The inner cap body 106 may be at least partially located within the outer shell 104. The inner cap body 106 extends from a proximal end 106*p* to a distal end 106*d* and may have a substantially cylindrical shape. In various embodiments, the distal end 106*d* may extend distally beyond the distal end 104*d* of the outer shell 104. The inner cap body 106 securely couples the cap 100 with the straw 102 (e.g., using internal threads 105 or projections configured to engage external threads or projections on the straw 102). For example, an inner surface 106 of the inner cap body 106 may include threads 105 configured to engage counterpart threads (not shown) on the straw 102. Alternative secure connection mechanisms between the inner cap body 106 and the straw 102 also fall within the scope of the present disclosure.

One or more ribs 110 extend between the inner cap body 106 and the outer shell 104. Each rib 110 can be rigid and can extend vertically (e.g., parallel to the central longitudinal A1). The ribs 110 may have a proximal portion that couples with the outer shell 104. The ribs 110 may also have a distal or terminal portion coupled with the tab 114 and/or break segment 116. While the illustrated embodiment of the cap 100 includes four ribs 110, one skilled in the art understands that the cap 100 of the present disclosure may have a greater or fewer number of ribs 110. The one or more ribs 110 can extend radially outward from an outer surface 1060 of the inner cap body 106 to an inner surface of the outer shell 104. In some embodiments, each rib 110 can extend along the inner surface 104*i* of the outer shell 104 from the proximal end 104*p* to the distal end 104*d* of the outer shell.

Figure 10C:
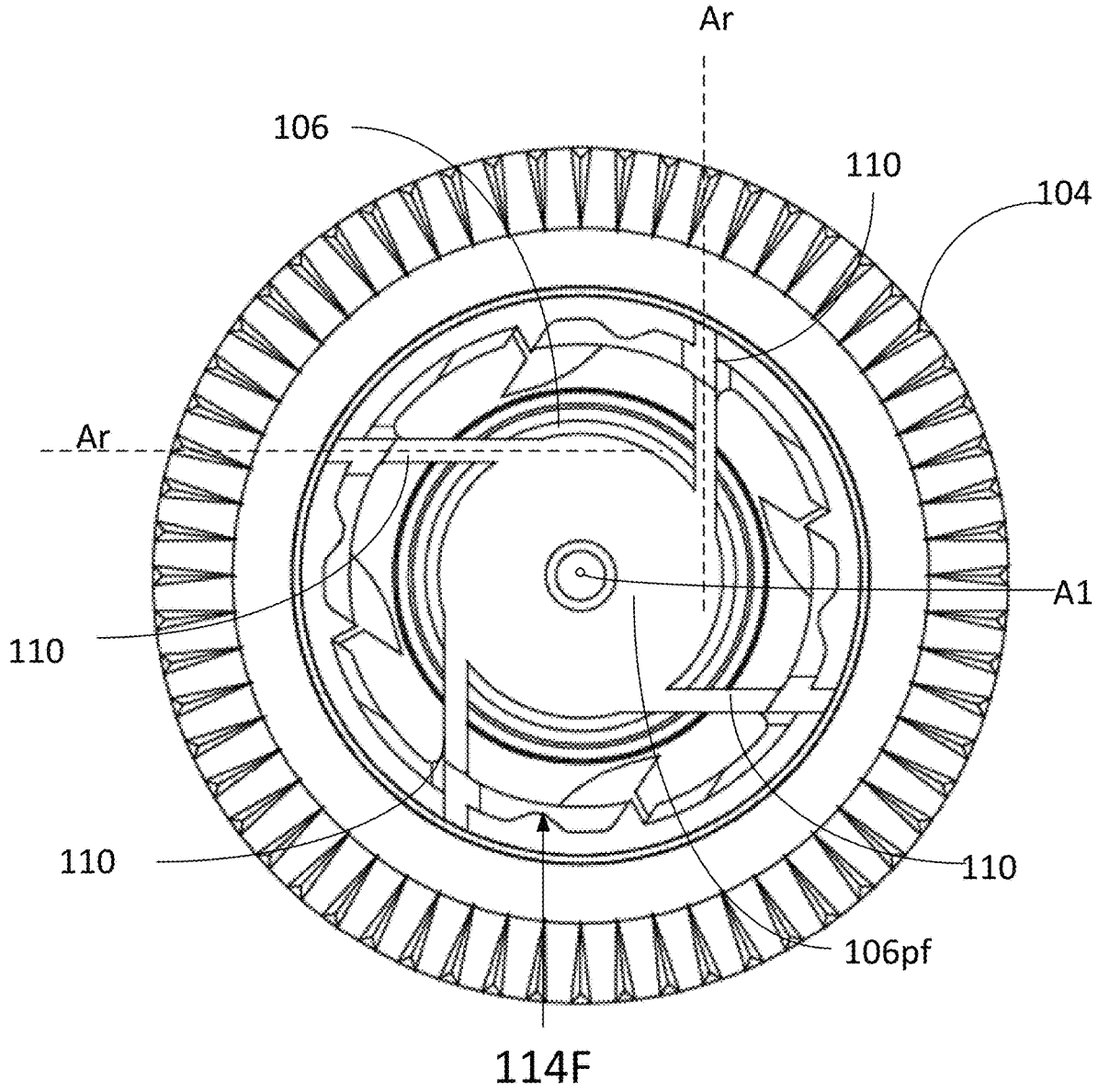

FIG. 10C schematically shows a top view of the cap 100 of FIG. 10B. In various embodiments, a proximal facing surface 106*pf* of the inner cap body 106 has a circular shape. Each of the ribs 110 extends between the outer shell 104 and the inner cap body 106. The ribs 110 may extend substantially at a tangent to the proximal facing surface 106*pf* of the inner cap body 106. Although shown extending at a tangent, the ribs may also extend radially outward from the proximal facing surface 106*pf* (e.g., in a cross-like orientation), or in any other suitable orientation. As shown in the figure, the ribs 110 may extend in the proximal direction beyond the proximal facing surface 106*pf*. Regardless of the shape of the proximal facing surface 106*pf*, the ribs 110 may be offset from the central longitudinal axis A1 (e.g., an axis Ar of the rib 110 does not intersect with the central longitudinal axis A1 of the cap 100). In other words, the ribs 110 may be substantially parallel to a plane including the central longitudinal axis A1. This contrasts with some other embodiments, where the rib axis Ar may with a plane that includes the central longitudinal axis A1.

Figure 11A:
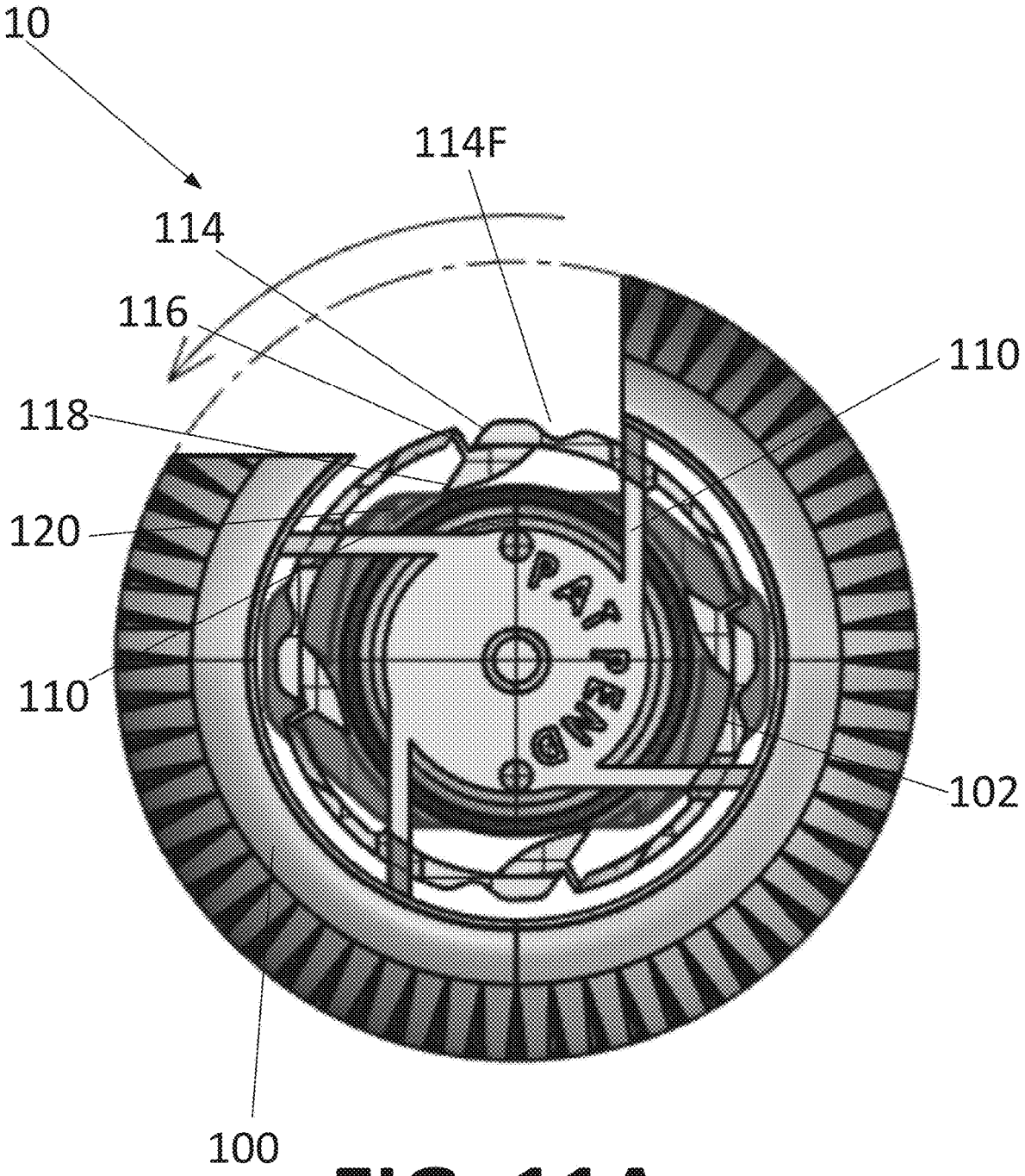
FIGS. 11A to 11C schematically show a partial cutaway view of the cap coupled with the straw in accordance with illustrative embodiments of the invention.
Figure 11B:
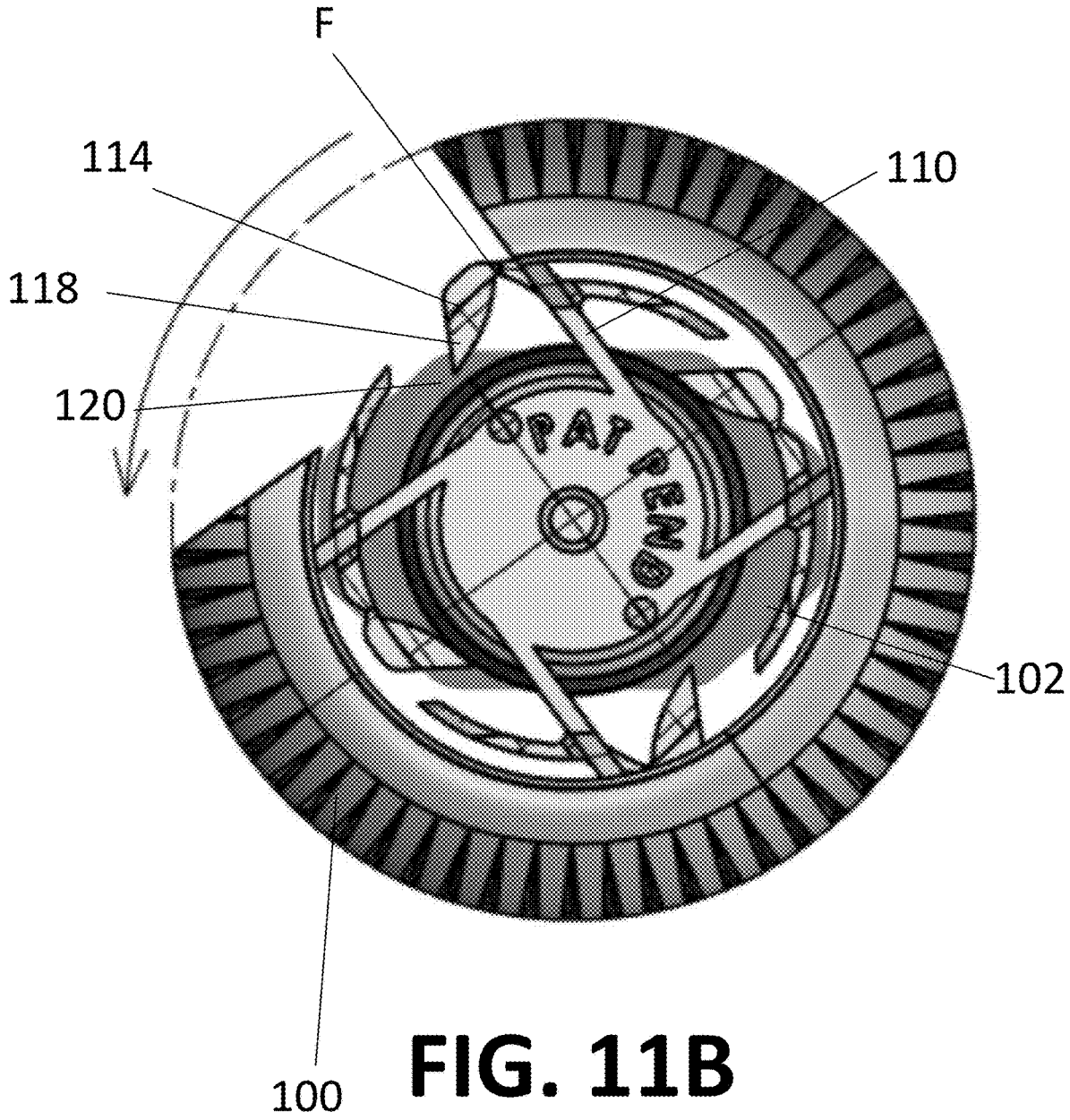
Figure 11C:
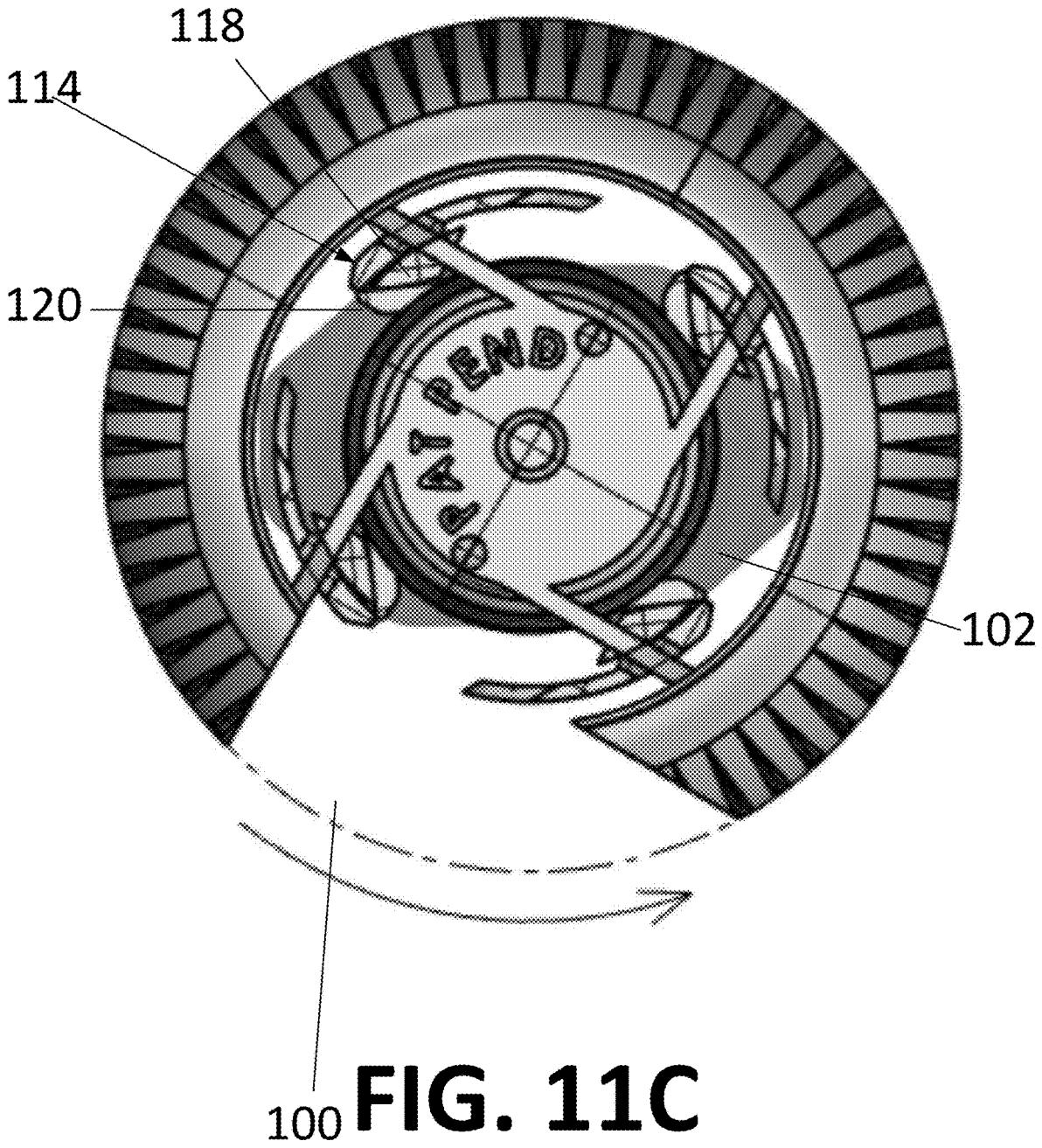

FIGS. 11A to 11C schematically show a partial cutaway view of the cap 100 coupled with the straw 102 in accordance with illustrative embodiments of the invention. In FIG. 11A the cap 100 is secured to the straw 102. To unsecure the cap 100 from the straw 102, the cap 100 is rotated in a counter-clockwise direction relative to the straw 102 (although other embodiments may be configured to open when the cap 100 is rotated in a clockwise direction). The tab 114 of the cap 100 may be coupled, directly or indirectly, with one or more ribs 110 integrally molded with the cap 100.

The tab 114 includes an inwardly projecting lug 118 configured to engage with the projection 120 when the cap 100 is rotated and the cap 100 is coupled with the straw 102. When the lug 118 and the projection 120 contact one another (i.e., engage one another), the user encounters resistance while turning the cap 100. When the user applies force that exceeds an uncoupling threshold, the engagement between the lug 118 and the projection 120 causes the tab 114 to fold inwardly on itself (as shown in FIG. 11B).

Unlike the cap 100 shown in FIGS. 4A-4C, the cap of FIGS. 11A-11C does not include the hinge 114R (e.g., adjacent to the rib 110). The tab 114 of FIGS. 11A-11C is therefore configured to resiliently bounce back to its initial configuration when flexed.

The lug 118 interferes with the projection 120 as the user rotates the cap 100. Because of the rigidity of the tab 114, and the lack of the hinge, the lug 118 deforms along the foldable portion F. In various embodiments, the foldable portion F is formed from a pre-thinned portion of the tab 114.

In various embodiments, the bridge 116 breaks in order for the tab 114 to fold. The bridge 116 holds the tab 114, either directly or indirectly, to a second rib 110. In various embodiments, the bridge 116 is configured so that the force normally applied by a user to unseal the device 10 (i.e., application of a threshold force by rotating the cap to overcome the engagement between the lug 118 and the projection 120) is sufficient to break the bridge 116. When the lug 118 engages with the projection 120, the lug 118 no longer rotates because of interference with the projection 120. Thus, continued application of force by the user (e.g., in the counter-clockwise direction) causes the bridge 116 to fracture, and the tab 114 to fold F at the foldable portion 114F. However, some embodiments may not include the bridge 116.

After the bridge 116 breaks, the lug 118 interferes with the projection 120 as the user rotates the cap 100. Because of the rigidity of the tab 114, and the lack of the hinge, the lug 118 deforms along the foldable portion F. In various embodiments, the foldable portion F is formed from a pre-thinned portion of the tab 114.

FIG. 11B schematically shows the device 10 of FIG. 11A after the bridge 116 is broken and the tab 114 folds in accordance with illustrative embodiments. As shown, the tab 114 folds along the fold F. Because there is no hinge, the tab 114 does not rotate outwardly as freely as the embodiment shown in FIG. 4B. However, the tab 114 may rotate outward slightly because of deformation caused by the application of force FIG. 11C schematically shows the device 10 of FIG. 11B visually indicating that the seal is broken in accordance with illustrative embodiments of the invention. FIG. 11C schematically shows the device 10 of FIG. 11B rotated further in the opening direction (e.g., in the counter-clockwise direction). In various embodiments, as the cap 100 rotates further, the projection 118 is folded inwardly as the tab 114 recoils back towards its original position. Thus, the tab 114 folds inwardly to visually indicate that the seal is broken (e.g., that the force required to break the bridge 116 has been overcome). The lug 118 and the projection 120 may continue to be in contact, although with considerably less resistance, until the cap 100 is rotated further. Accordingly, the user may now visually identify that the container 8 has been tampered with or opened.

Figure 12A:
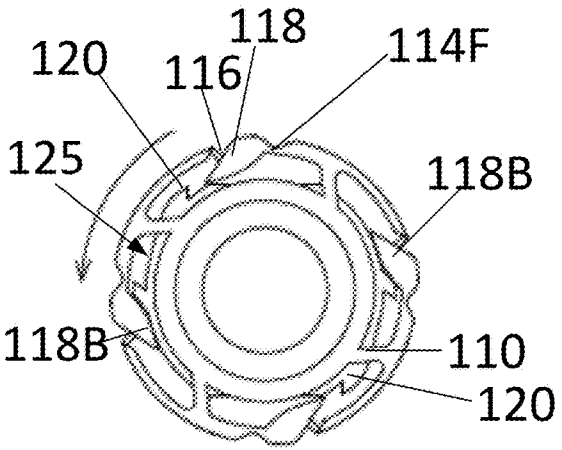
FIGS. 12A-12C schematically show a partially exposed top view of the device, the cap, and the straw, respectively, in a sealed configuration in accordance with illustrative embodiments of the invention.
Figure 12B:
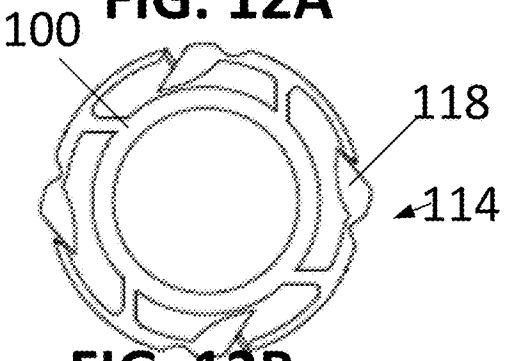
Figure 12C:
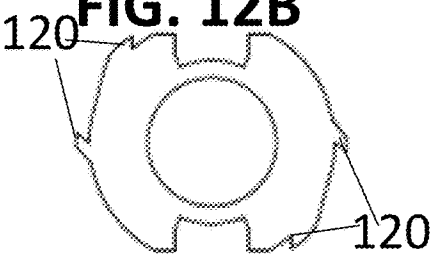

FIGS. 12A-12C schematically show a partially exposed top view of the device 10, the cap 100, and the straw 102, respectively, in a sealed configuration in accordance with illustrative embodiments of the invention. In particular, FIG. 6B schematically shows the cap 100 in an isolated view in the sealed configuration. FIG. 12C schematically shows the straw 102 in an isolated view in the sealed configuration. The device 10 is configured so that the lug 118 of the cap 100 moves (e.g., slides) along the outer edge 125 of the straw 102. In some embodiments, the edge 125 may be smooth and/or may be sized so that the lug 118 is not prevented from rotating. In contrast, the projection 120 is configured to engage with the lug 118 to prevent further rotation of the lug 118 without unsealing the device 10 (i.e., breaking or otherwise modifying the tab 114).

It should be apparent that although various embodiments refer to the tab 114, the lug 118, the projection 120, and other components in the singular, that various embodiments may have one or more of these items. In the illustrative embodiment shown in FIGS. 12A-12C, for example, there are four tabs 114, each with a respective lug 118, and there are four projections 120 on the straw 102.

It should further be noted that some embodiments are configured to unseal when rotated in a first direction (e.g., counter-clockwise), but not when rotated in a second direction (e.g., clockwise). For example, in the example of FIG. 12A, the device is opened/unsealed when the cap 100 is rotated counter-clockwise relative to the straw 102. Some embodiments may have features configured to prevent the cap 100 from rotating clockwise. Alternatively, the cap 100 may rotate clockwise without opening/unsealing the device 10. For example, the lug 118 may slide up and over the projection 120 when rotated clockwise, while the tab 114 flexes without the bridge 116 breaking and/or without the tab 114 folding.

The cap 100 is rotated until the lug 118 engages with the projection 120. FIG. 12A shows the lug 118 just before it engages with a respective projection 120. Additionally, two other lugs 118B may be configured to engage with the projections 120 at a later time (i.e., after further rotation).

When the lug 118 engages the projection 120, the process 500 proceeds to step 508, which applies sufficient force to transition the device into the unsealed configuration. In various embodiments, this includes breaking the bridge 116, folding the tab 114, and/or rotating the tab 114 around the hinge 114R for the one or more tabs 114. In various embodiments, breaking the bridge 116, folding the tab 114, and/or rotating the tab 114 around the hinge 114R may occur simultaneously or in sequence, based on the configuration of the device 10. Additionally, various embodiments may be tuned to configure the threshold force required to transition the device into the unsealed configuration. However, those skilled in the art will understand that various embodiments require a threshold of force generally used to open sealed containers (e.g., bottle of soda).

Figure 13A:
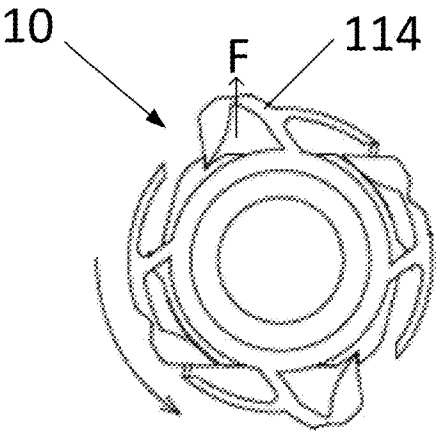
FIGS. 13A-13C schematically show a partially exposed top view of the device, the cap, and straw, respectively, as the seal is broken in accordance with illustrative embodiments of the invention.
Figure 13B:
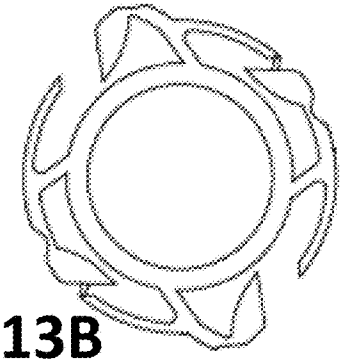
Figure 13C:
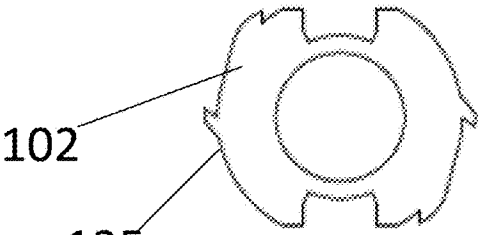

The cap 100 may be rotated until all of the bridges 116 are broken and/or the tabs 114 are folded. FIGS. 13A-13C schematically show a partially exposed top view of the device 10, the cap 100, and straw 102, respectively, as the seal is broken in accordance with illustrative embodiments of the invention. As shown in FIGS. 13A and 13B, the bridge 116 breaks when sufficient rotational force (a "breaking force") is applied by the user to overcome the interference between the lug 118 and the projection 120. In various embodiments, the breaking force causes the tab 114 to fold F along the foldable portion 114F. Some embodiments may have tabs 114 that include one or more of the breakable bridge 116, and/or the foldable portion 114F.

Figure 14A:
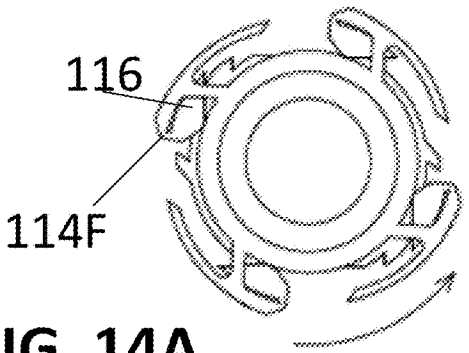
FIGS. 14A-14C schematically show a partially exposed top view of the device, the cap, and straw, respectively, in a visibly tampered configuration in accordance with illustrative embodiments of the invention.
Figure 14B:
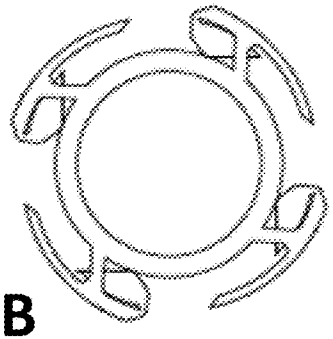
Figure 14C:
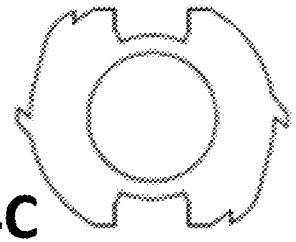

By folding the tab 114 inwardly, a visual indication is provided that the seal is broken. The user may now clearly see that the device 10 has been tampered with or is in the unsealed configuration. FIGS. 14A-14C schematically show a partially exposed top view of the device 10, the cap 100, and straw 102, respectively, in a visibly tampered configuration in accordance with illustrative embodiments of the invention. In the visibly tampered configuration, the tab is rotated inwardly, easily alerting any user that the seal is broken, and that the contents with the container 8 may have been accessed.

Figures 15A, 15B, 15C:
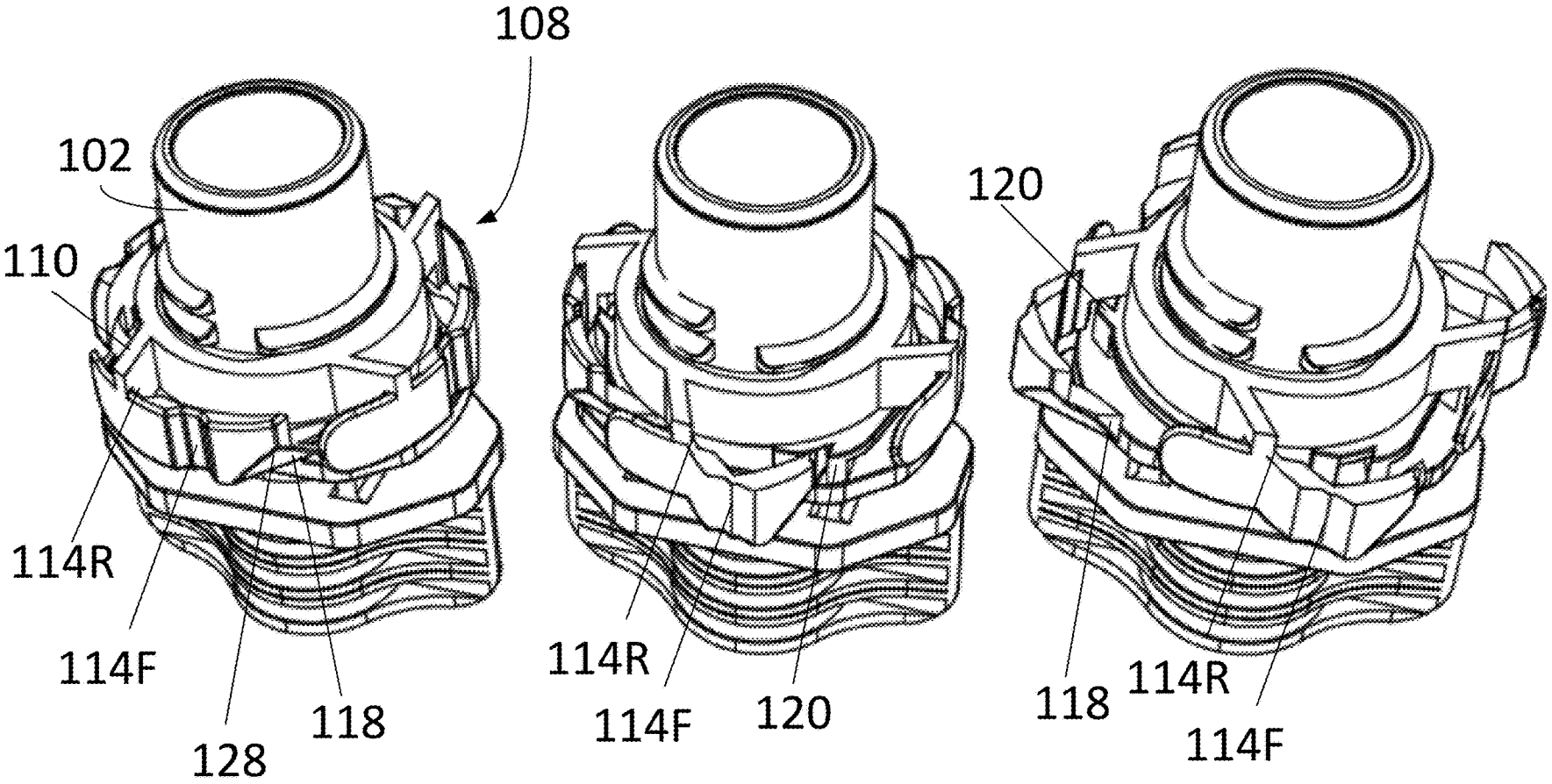
FIGS. 15A-15C schematically shows the tamper evident band of FIGS. 1-9C with the inner cap body and the outer shell omitted for clarity.
Figures 16A, 16B, 16C:
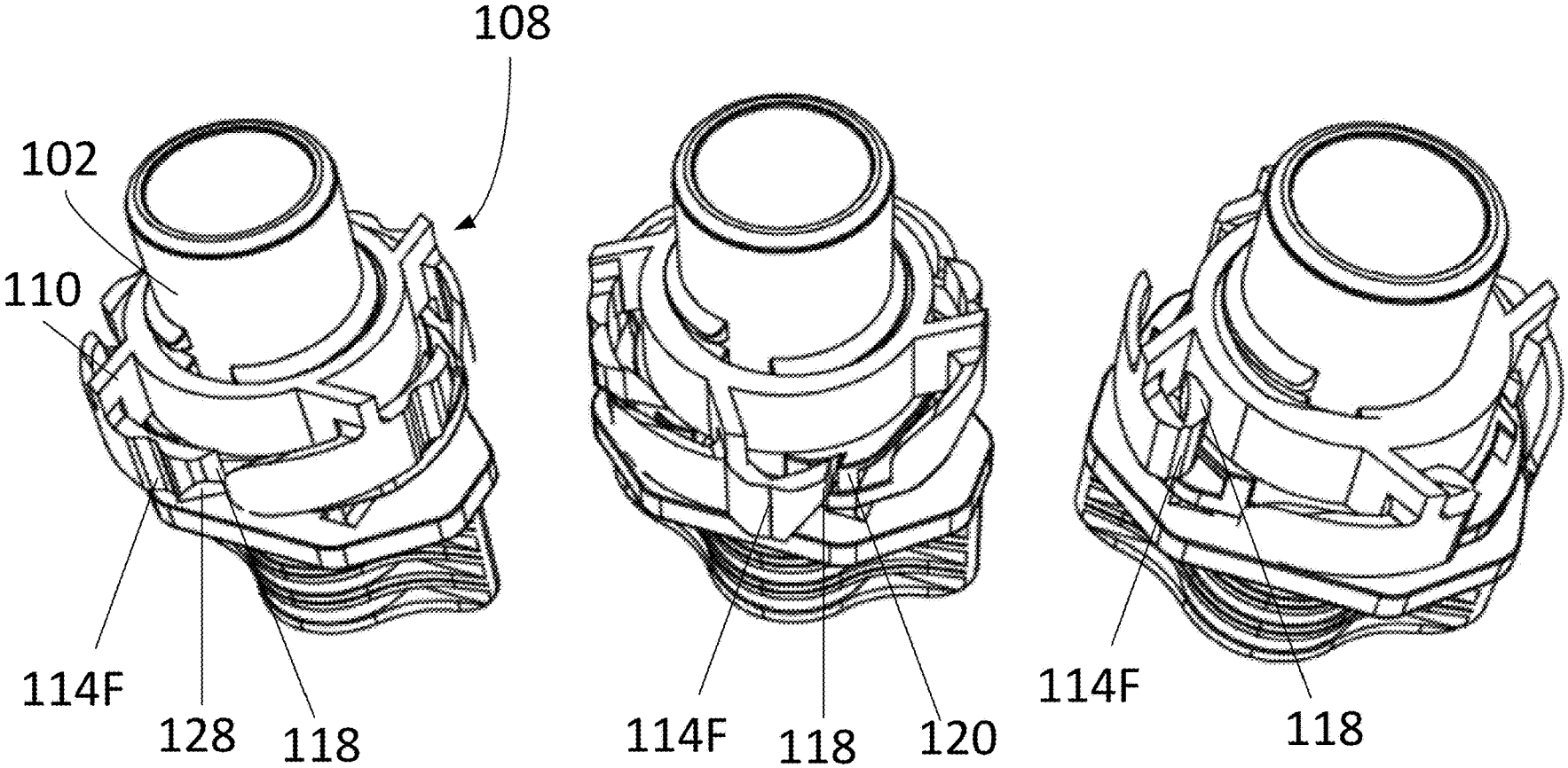
FIG. 16A-16C schematically show the tamper evident band of FIGS. 10A-14C with the inner cap body and the outer shell omitted for clarity.

FIGS. 15A-15C schematically show the tamper evident band 108 with the inner cap body 106 and the outer shell 104 omitted for clarity. FIGS. 15A-15C show the transition of the device 10 from the sealed configuration in FIG. 15A to the unsealed configuration in FIG. 15C. In a similar manner, FIGS. 16A-16C schematically show an alternative embodiment of the tamper evident band 108 with the inner cap body 106 and the outer shell 104 omitted for clarity. As shown, the tamper evident band 108 surrounds the straw 102. The lug 118 interacts with the projection 120 as the cap 100 rotates, and provides a visual indication that the seal between the cap 100 and the straw 102 is broken. In FIGS. 15A-15C, the tab 114 swings outwardly. In FIGS. 16A-16C, the tab 114 folds inwardly.

Various embodiments may include a slidable surface 128 on the lug 118. The slidable surface 128 is configured to ride over or slide on the projections 120. Advantageously, this reduces or prevents the ratcheting noise when screwing the cap 100 back on and off of the straw 102 after unsealing. In various embodiments, the surface 128 may be a chamfered or beveled surface. However, in some other embodiments, the slidable surface 128 may be on a top portion of the lug 118, such that the lug 118 rides under the projection 120.

Figure 17:
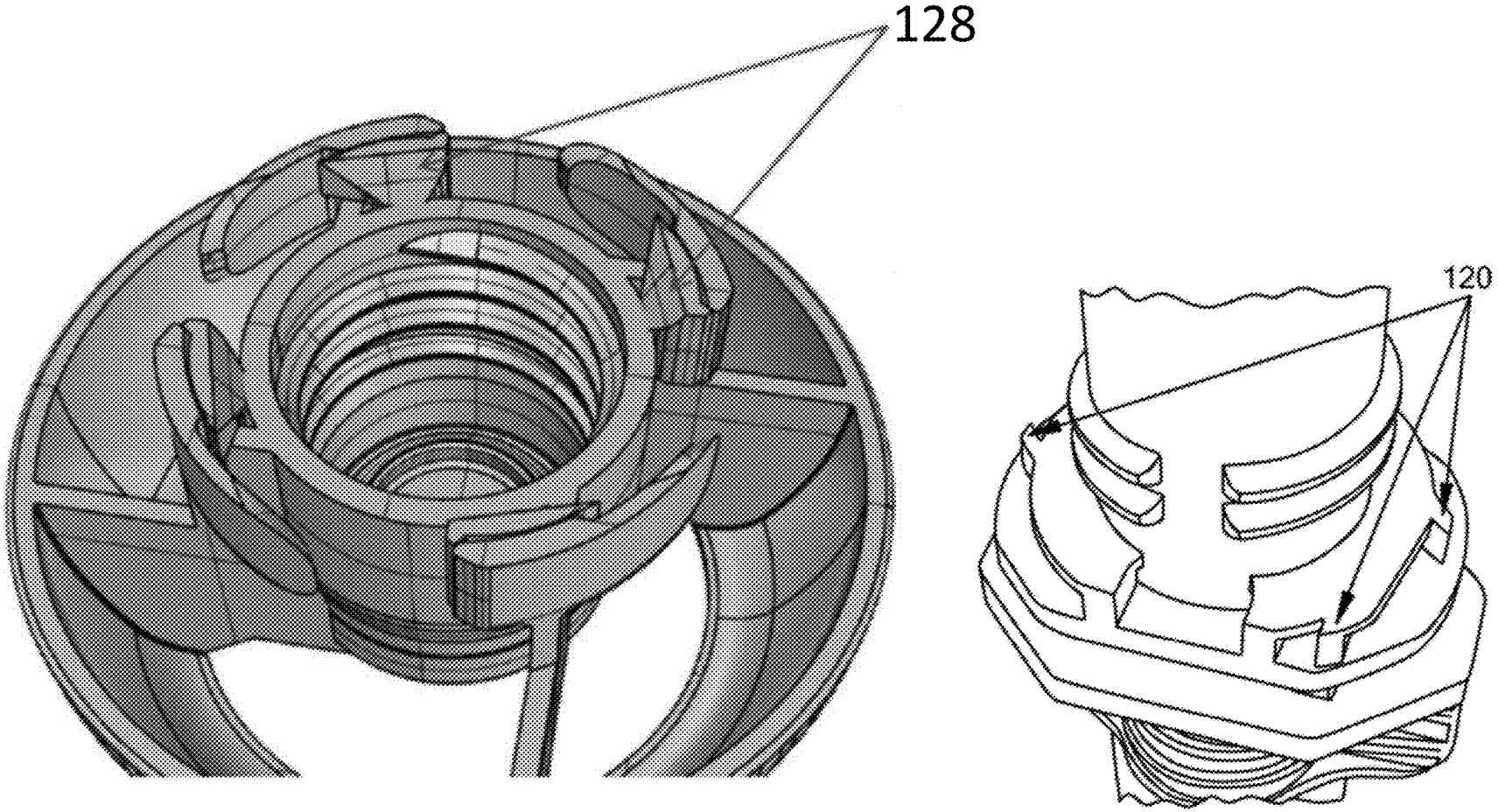
FIG. 17 schematically shows details of the lug in accordance with illustrative embodiments of the invention.

FIG. 17 schematically shows details of the slidable surface 128 in accordance with illustrative embodiments of the invention. Specifically, FIG. 17 shows the foldable tab 114 having the slidable surface 128. In some embodiments the slideable surface 128 may be a chamfered surface 128. The slidable surface 128 allows the lug 118 to slide silently over the projections 120 of the straw 102 without making a ratcheting noise. Accordingly, the user may hear a distinct unsealing sound when initially unsealing the cap 100 from the straw 102 as compared to when the cap 100 is removed from the straw 102 in the unsealed configuration.

Figure 18:
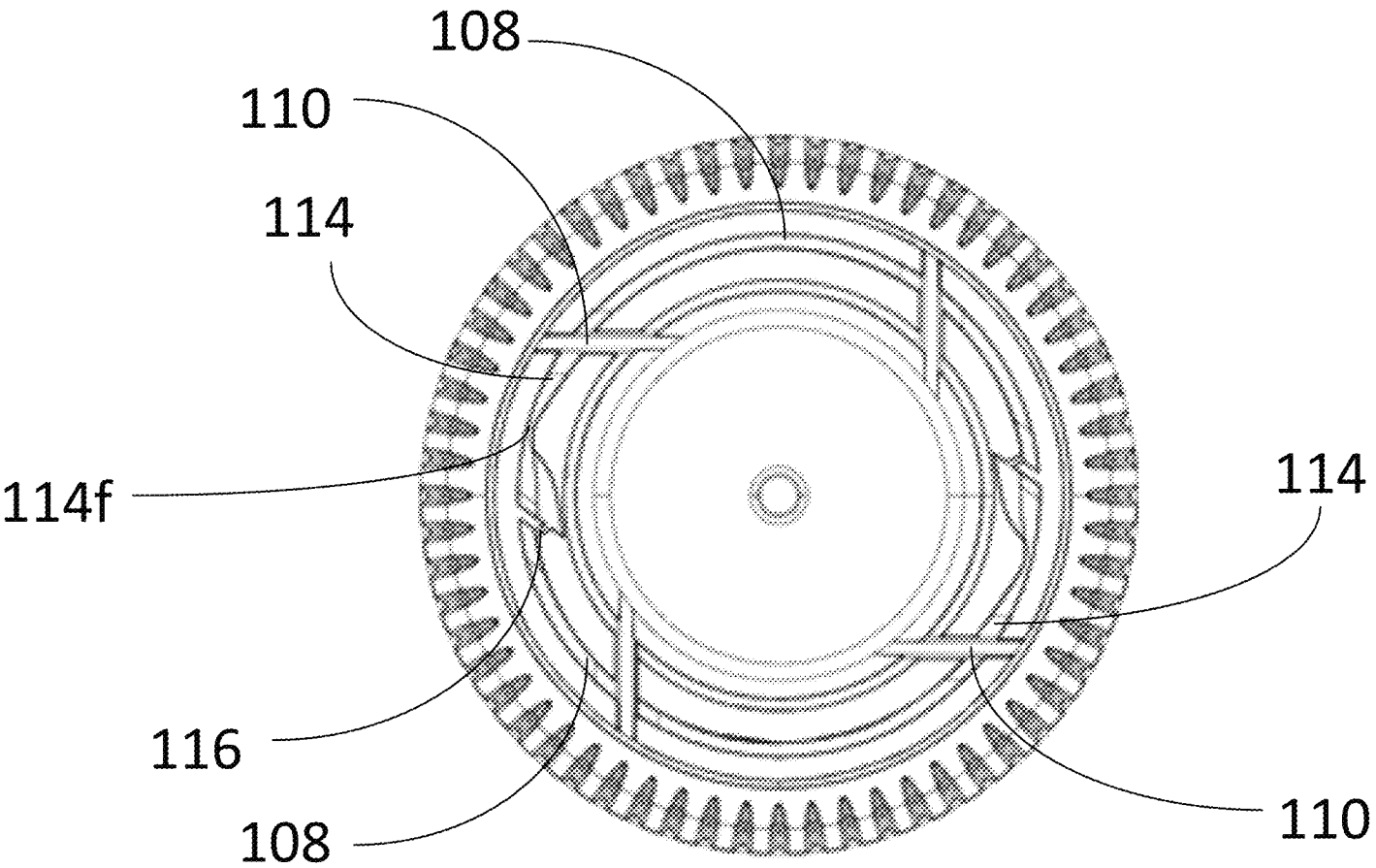
FIG. 18 schematically shows an alternative embodiment of the cap in accordance with illustrative embodiments of the invention.

FIG. 18 schematically shows an alternative embodiment of the cap 100 in accordance with illustrative embodiments of the invention. As shown, the cap 100 includes two tabs 114, each having a foldable portion 114*f*. The tabs 114 may be formed as part of, and co-planar with, the tamper-evident band 108. Each of the tabs 114 extends from the nearest adjacent rib 110. Although various embodiments show two or four tabs 114, it should be understood that some embodiments may have more or fewer tabs 114. For example, some embodiments may include a single tab 114 (e.g., extending from the rib 110). Some other embodiments may include three, five, six, seven, eight, nine, ten, or greater tabs 114. For example, some embodiments may include up to twenty tabs 114 (e.g., twelve or sixteen tabs 114).

As used in this specification and the claims, the singular forms "a," "an," and "the" refer to plural referents unless the context clearly dictates otherwise. For example, reference to "a tab" in the singular includes a plurality of tabs, and reference to "the projection" in the singular includes one or more projections and equivalents known to those skilled in the art. Thus, in various embodiments, any reference to the singular includes a plurality, and any reference to more than one component can include the singular.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein.

It is, therefore, to be understood that the foregoing embodiments are presented by way of example only and that, within the scope of the appended claims and equivalents thereto, inventive embodiments may be practiced otherwise than as specifically described and claimed. Illustrative embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure. Disclosed embodiments, or portions thereof, may be combined in ways not listed above and/or not explicitly claimed. Thus, one or more features from variously disclosed examples and embodiments may be combined in various ways.

Various inventive concepts may be embodied as one or more methods, of which examples have been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Although the above discussion discloses various exemplary embodiments of the invention, it should be apparent that those skilled in the art can make various modifications that will achieve some of the advantages of the invention without departing from the true scope of the invention.

What is claimed is:

1. A tamper-evident closure for a container, the closure comprising:

a straw having an outer edge with an outwardly extending projection;

a cap having a rib with a tab extending from the rib, the tab having an inwardly extending lug configured to engage with an outwardly extending projection of the straw as the cap rotates relative to the straw when the cap and the straw are secured together, the tab having a hinge coupled with the rib, the hinge configured to rotate the tab outwardly relative to the rib, the tab further having a foldable portion configured to fold the outwardly rotated tab.

2. The tamper-evident closure of claim 1, wherein the tab includes a break segment configured to break when a threshold force is applied to transition the closure from a sealed configuration to an unsealed configuration.

3. The tamper-evident closure of claim 2, wherein the cap has a plurality of ribs, wherein the hinge is coupled with a first rib and the break segment is coupled with a second rib.

4. The tamper-evident closure of claim 1, wherein the cap includes an outer shell having gripping features; and an inner cap body.

5. The tamper-evident closure of claim 4, wherein the inner cap body includes internal threads configured to engage with external threads on the straw.

6. The tamper-evident closure of claim 4, wherein the plurality of ribs extend from the inner cap body to the outer shell.

7. The tamper-evident closure of claim 4, wherein a ratio of a maximum height of the outer shell to a height of one of the plurality of tabs is less than or equal 6:1.

8. The tamper-evident closure of claim 1, wherein the hinge comprises a recessed portion.

9. A method of visually indicating that a container has been tampered with, the method comprising:

providing a container in a sealed configuration, the container having:

a straw having an outer edge with an outwardly extending projection, and a cap sealed to the straw, the cap having a rib with a tab extending from the rib, the tab having an inwardly extending lug configured to engage with the outwardly extending projection of the straw as the cap is rotated relative to the straw, the tab having a hinge coupled with the rib, the hinge configured to swing the tab outwardly relative to the rib, the tab further having a foldable portion configured to fold;

rotating the cap relative to the straw to overcome a threshold force;

swinging the tab outwardly at the hinge; and folding the tab at the foldable portion.

10. The method of claim 9, wherein the tab includes a break segment, configured to break when the threshold force is applied.

11. The method of claim 10, further comprising breaking the break segment.

12. The method of claim 9, wherein rotating the cap relative to the straw causes the lug of the cap to engage with the projection of the straw.

13. The method of claim 9, wherein the cap has a plurality of ribs, wherein the hinge is coupled with a first rib and the break segment is coupled with a second rib.

14. The method of claim 9, wherein the cap includes an outer shell having gripping features; and an inner cap body, the inner cap body having threads configured to engage with external threads on the straw.

15. The tamper-evident closure of claim 14, wherein the plurality of ribs extend from the inner cap body to the outer shell.

16. The tamper-evident closure of claim 14, wherein a ratio of a maximum height of the outer shell to a height of one of the plurality of tabs is less than or equal 6:1.

17. A tamper-evident system comprising:

a container configured to house a fluid;

a straw partially sealed within the container, the straw having an exposed portion and an unexposed portion, the straw further having an exposed outer edge with an outwardly extending projection;

a cap having an inner cap body and an outer shell, the cap having a rib extending from the inner cap body to the outer shell; and one or more tabs configured to rotate outwardly, the tab further having a foldable portion configured to fold.

18. The system of claim 17, wherein the one or more tabs include a break segment.

19. The system of claim 17, wherein the tab extends from the rib, the tab having an inwardly extending lug configured to engage with the outwardly extending projection of the straw as the cap is coupled with and rotated relative to the straw.

20. The system of claim 17, wherein a ratio of a maximum height of the outer shell to a height of one of the plurality of tabs is less than or equal 6:1.

* * * * *